US011545165B2

(12) United States Patent
Nagisetty et al.

(10) Patent No.: US 11,545,165 B2
(45) Date of Patent: Jan. 3, 2023

(54) ENCODING DEVICE AND ENCODING METHOD USING A DETERMINED PREDICTION PARAMETER BASED ON AN ENERGY DIFFERENCE BETWEEN CHANNELS

(71) Applicant: Panasonic Intellectual Property Corporation of America, Torrance, CA (US)

(72) Inventors: Srikanth Nagisetty, Singapore (SG); Hiroyuki Ehara, Kanagawa (JP); Rohith Mars, Singapore (SG); Chong Soon Lim, Singapore (SG); Toshiaki Sakurai, Kanagawa (JP)

(73) Assignee: PANASONIC INTELLECTUAL PROPERTY CORPORATION OF AMERICA, Torrance, CA (US)

( * ) Notice: Subject to any disclaimer, the term of this patent is extended or adjusted under 35 U.S.C. 154(b) by 101 days.

(21) Appl. No.: 17/256,899

(22) PCT Filed: Jul. 2, 2019

(86) PCT No.: PCT/JP2019/026200
§ 371 (c)(1),
(2) Date: Dec. 29, 2020

(87) PCT Pub. No.: WO2020/009082
PCT Pub. Date: Jan. 9, 2020

(65) Prior Publication Data

US 2021/0280201 A1 Sep. 9, 2021

(30) Foreign Application Priority Data

Jul. 3, 2018 (JP) ..... JP2018-126842
Nov. 7, 2018 (JP) ..... JP2018-209940

(51) Int. Cl.
*G10L 19/04* (2013.01)
*G10L 19/008* (2013.01)
*G10L 19/02* (2013.01)

(52) U.S. Cl.
CPC ..... *G10L 19/04* (2013.01); *G10L 19/008* (2013.01); *G10L 19/0212* (2013.01)

(58) Field of Classification Search
None
See application file for complete search history.

(56) References Cited

U.S. PATENT DOCUMENTS 6,393,392 B1 * 5/2002 Minde ..... G10L 19/16 704/219
2008/0091439 A1 * 4/2008 Baumgarte ..... H04S 3/02 704/500

(Continued)

FOREIGN PATENT DOCUMENTS

JP 5122681 B2 1/2013
JP 2014-516425 A 7/2014

(Continued)

OTHER PUBLICATIONS

"Low-complexity, full-band audio coding for high-quality, conversational applications", Series G: Transmission Systems and Media, Digital Systems and Networks, Recommendation ITU-T G.719, Jun. 2008, pp. 1-58.

(Continued)

*Primary Examiner* — Shaun Roberts
(74) *Attorney, Agent, or Firm* — Greenblum & Bernstein, P.L.C.

(57) ABSTRACT

This encoding device is able to encode an S signal efficiently in MS prediction encoding. An M signal encoding unit generates first encoding information by encoding a sum signal indicating a sum of a left channel signal and a right channel signal that constitute a stereo signal. An energy (Continued)

difference calculation unit calculates a prediction parameter for predicting a difference signal indicating a difference between the left channel signal and the right channel signal by using a parameter regarding an energy difference between the left channel signal and the right channel signal. An entropy encoding unit generates second encoding information by encoding the prediction parameter.

7 Claims, 13 Drawing Sheets

(56) References Cited

U.S. PATENT DOCUMENTS

2009/0030704 A1* 1/2009 Takagi ..... H04S 3/006 704/E21.001
2009/0055198 A1* 2/2009 Liebchen ..... G10L 19/167 704/500
2011/0022398 A1* 1/2011 Mansour ..... G10L 19/173 704/500
2011/0096932 A1 4/2011 Schuijers
2012/0002818 A1* 1/2012 Heiko ..... H04S 5/005 381/23
2012/0033770 A1* 2/2012 Zhang ..... H04S 3/00 375/350
2012/0275604 A1 11/2012 Vos
2013/0030819 A1 1/2013 Purnhagen et al.
2013/0121411 A1* 5/2013 Robillard ..... H04N 19/70 375/240.12
2016/0055855 A1* 2/2016 Kjoerling ..... G10L 19/04 704/500
2017/0148447 A1* 5/2017 Atti ..... G10L 25/51
2017/0270936 A1 9/2017 Chebiyyam et al.
2018/0197552 A1 7/2018 Fuchs et al.

FOREIGN PATENT DOCUMENTS

JP 5705964 B2 4/2015
WO 2017/125562 A1 7/2017
WO 2017/161315 A1 9/2017

OTHER PUBLICATIONS

"Auto codec processing functions; Extended Adaptive Multi-Rate—Wideband (AMR-WB+) codec; Transcoding functions; 3rd Generation Partnership Project; Technical Specification Group Services and System Aspects (Release 12)", 3GPP TS 26.290, V12.0.0, Sep. 2014, pp. 1-85.
International Search Report (including English Language Translation), dated Sep. 10, 2019 by the Japan Patent Office (JPO), in International Appl. No. PCT/JP2019/026200.

* cited by examiner

ENCODING DEVICE AND ENCODING METHOD USING A DETERMINED PREDICTION PARAMETER BASED ON AN ENERGY DIFFERENCE BETWEEN CHANNELS

TECHNICAL FIELD

The present disclosure relates to an encoder and an encoding method.

BACKGROUND ART

A Middle/Side (M/S) stereo codec converts signals of channels (left channel and right channel) constituting a stereo signal into an M signal (also called sum signal) and an S signal (also called difference signal), and encodes the M signal and S signal by a mono speech audio codec. In addition, an encoding method for the M/S stereo codec to predict the S signal using the M signal (hereinafter referred to as MS predictive encoding) has been proposed (see, for example, Patent Literatures (hereinafter referred to as "PTLs") 1 to 3).

CITATION LIST

Patent Literature

PTL 1
Japanese Patent No. 5122681
PTL 2
Japanese Unexamined Patent Application Publication (Translation of PCT Application) No. 2014-516425
PTL 3
Japanese Patent No. 5705964

Non-Patent Literature

Non-Patent Literature 1
Recommendation ITU-T G.719 (June 2008), "Low-complexity, full-band audio encoding for high-quality, conversational applications," ITU-T, 2008.
Non-Patent Literature 2
3GPP TS 26.290 V12.0.0, "Audio codec processing functions; Extended Adaptive Multi-Rate-Wideband (AMR-WB+) codec; Transcoding functions (Release 12)," 2014-09

SUMMARY OF INVENTION

However, a method for efficiently encoding the S signal in the MS predictive encoding has not been comprehensively studied.

One non-limiting and exemplary embodiment facilitates providing an encoder and an encoding method that can efficiently encode the S signal in the MS predictive encoding.

An encoder according to an exemplary embodiment of the present disclosure includes: first encoding circuitry, which, in operation, encodes a sum signal to generate first encoding information, the sum signal indicating a sum of a left channel signal and a right channel signal constituting a stereo signal; calculation circuitry, which, in operation, calculates a prediction parameter using a parameter relating to an energy difference between the left channel signal and the right channel signal, the prediction parameter being a parameter for predicting a difference signal indicating a difference between the left channel signal and the right channel signal; and second encoding circuitry, which, in operation, encodes the prediction parameter to generate second encoding information.

An encoding method according to an exemplary embodiment of the present disclosure includes: encoding a sum signal to generate first encoding information, the sum signal indicating a sum of a left channel signal and a right channel signal constituting a stereo signal; calculating a prediction parameter using a parameter relating to an energy difference between the left channel signal and the right channel signal, the prediction parameter being a parameter for predicting a difference signal indicating a difference between the left channel signal and the right channel signal; and encoding the prediction parameter to generate second encoding information.

Note that these generic or specific aspects may be achieved by a system, an apparatus, a method, an integrated circuit, a computer program, or a recoding medium, and also by any combination of the system, the apparatus, the method, the integrated circuit, the computer program, and the recoding medium.

According to an exemplary embodiment of the present disclosure, it is possible to efficiently encode an S signal in MS predictive encoding.

Additional benefits and advantages of one example of the present disclosure will become apparent from the specification and drawings. The benefits and/or advantages may be individually obtained by the various embodiments and features of the specification and drawings, which need not all be provided in order to obtain one or more of such benefits and/or advantages.

DESCRIPTION OF EMBODIMENTS

Hereinafter, embodiments of the present disclosure will be described in detail with reference to the accompanying drawings.

Embodiment 1

[Overview of Communication System]

A communication system according to the present embodiment includes encoder 100 and decoder 200.

Figure 1:
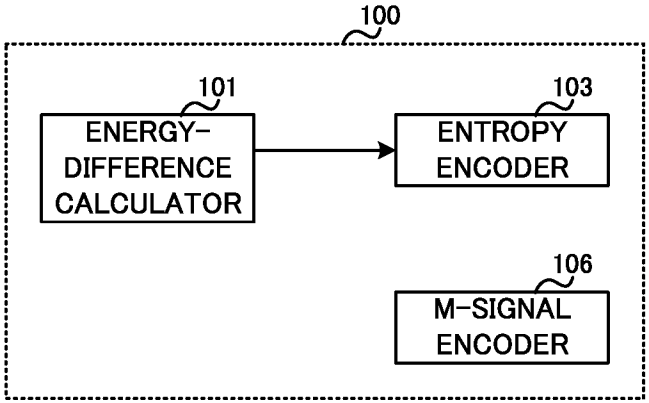
FIG. 1 is a block diagram illustrating a configuration example of a part of an encoder according to Embodiment 1.

FIG. 1 is a block diagram illustrating a configuration example of a part of encoder 100 according to the present embodiment. In encoder 100 illustrated in FIG. 1, M-signal encoder 106 encodes a sum signal indicating the sum of a left channel signal and a right channel signal constituting a stereo signal, so as to generate first encoding information.

Energy-difference calculator 101 calculates a prediction parameter for predicting a difference signal indicating a difference between the left channel signal and the right channel signal using a parameter relating to an energy difference between the left channel signal and the right channel signal. Entropy encoder 103 encodes the prediction parameter to generate second encoding information.

[Configuration of Encoder]

Figure 2:
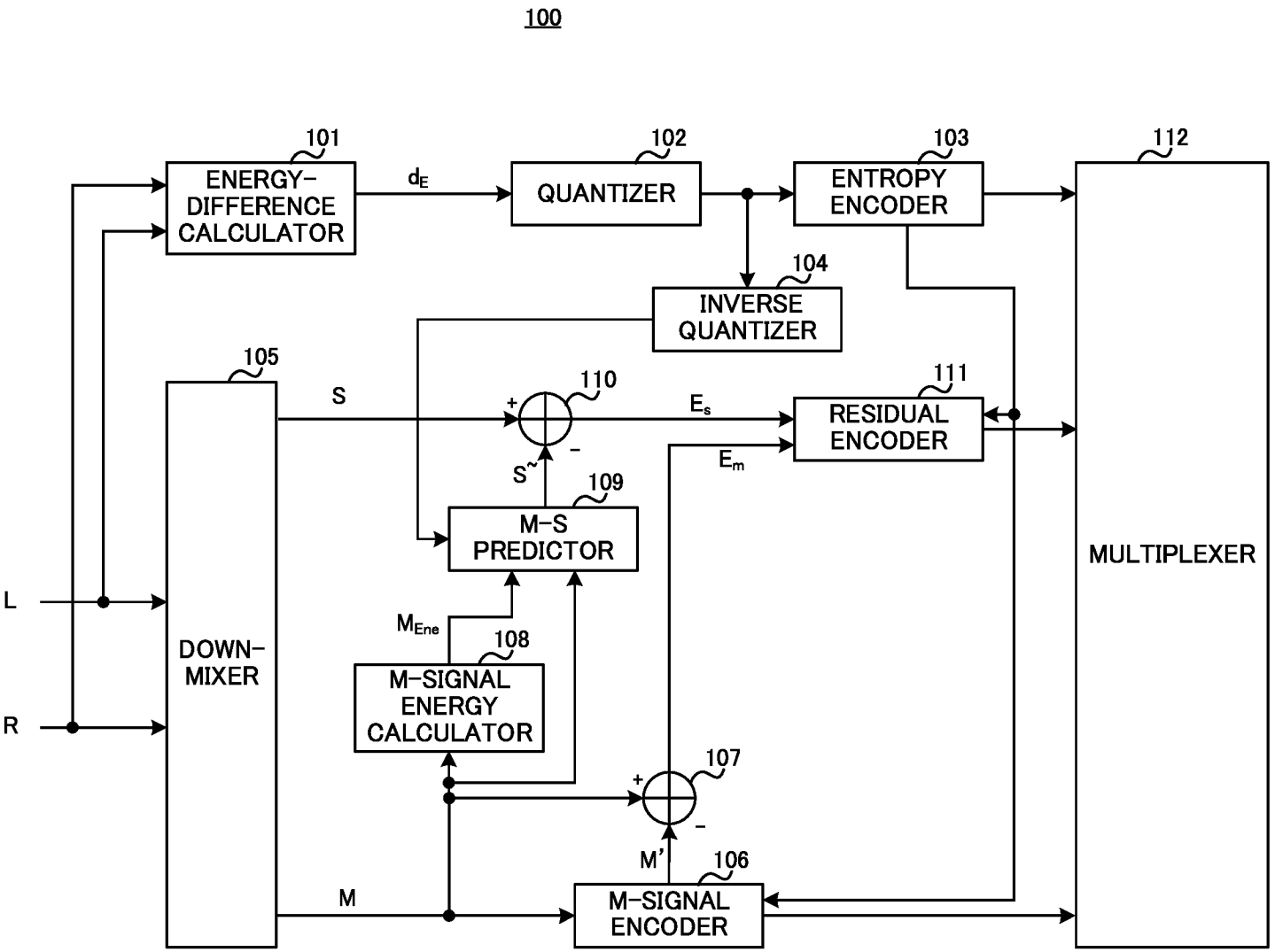
FIG. 2 is a block diagram illustrating a configuration example of the encoder according to Embodiment 1.

FIG. 2 is a block diagram illustrating a configuration example of encoder 100 according to the present embodiment. In FIG. 2, encoder 100 includes energy-difference calculator 101, quantizer 102, entropy encoder 103, inverse quantizer 104, down-mixer 105, M-signal encoder 106, adder 107, M-signal energy calculator 108, M-S predictor 109, adder 110, residual encoder 111, and multiplexer 112.

FIG. 2 illustrates that an L signal (Left channel signal) and an R signal (Right channel signal) constituting a stereo signal are inputted to energy-difference calculator 101 and down-mixer 105.

Energy-difference calculator 101 calculates the energy of the L signal and the energy of the R signal, and calculates energy difference $d_E$ between the L signal and the R signal. Energy-difference calculator 101 outputs calculated energy difference $d_E$ to quantizer 102 as a prediction parameter for predicting an S signal (difference signal) indicating a difference between the L signal and the R signal.

Quantizer 102 performs scalar quantization on the prediction parameter inputted from energy-difference calculator 101 and outputs an obtained quantization index to entropy encoder 103 and inverse quantizer 104. Note that, the quantization index may a difference taken between adjacent subbands. For example, quantizer 102 may perform subband quantization (referred to as "differential quantization") between the adjacent subbands. When quantization values are close to each other between the adjacent subbands, performing the differential quantization may sometimes make the entropy encoding more efficient.

Entropy encoder 103 performs entropy encoding (for example, Huffman encoding or the like (see Non-Patent Literature 1 or Non-Patent Literature 2) on the quantization index inputted from quantizer 102, and outputs an encoding result (prediction-parameter encoding information) to multiplexer 112.

Further, entropy encoder 103 calculates the number of bits necessary for the encoding result, and outputs information indicating a difference (the number of extra bits) between the maximum number of bits available for the encoding result and the calculated number of bits (in other words, information indicating by what number of bits the number of necessary bits is smaller than the maximum number of bits) to at least one of M-signal encoder 106 and residual encoder 111.

Inverse quantizer 104 decodes the quantization index inputted from quantizer 102 and outputs the obtained decoded prediction parameter (decoded energy difference) to M-S predictor 109.

Down-mixer 105 converts the inputted L and R signals into an M signal (sum signal) indicating the sum of the L signal and the R signal, and, an S signal (difference signal) indicating the difference between the L signal and the R signal (LR-MS conversion). Down-mixer 105 outputs the M signal to M-signal encoder 106, adder 107, M-signal energy calculator 108, and M-S predictor 109. Down-mixer 105 outputs the S signal to adder 110.

For example, down-mixer 105 converts the L signal (L(f)) and the R signal (R(f)) into the M signal (M(f)) and the S signal (SW) in accordance with Equation 1:

[1]

$$\begin{bmatrix} M(f) \\ S(f) \end{bmatrix} = \begin{bmatrix} 0.5 & 0.5 \\ 0.5 & -0.5 \end{bmatrix} \begin{bmatrix} L(f) \\ R(f) \end{bmatrix}. \quad \text{(Equation 1)}$$

Note that, while Equation 1 represents the LR-MS conversion in the frequency domain (at frequency 1), down-mixer 105 may also perform the LR-MS conversion in the time domain (at time n) as shown by Equation 2, for example:

[2]

$$\begin{bmatrix} m(n) \\ s(n) \end{bmatrix} = \begin{bmatrix} 0.5 & 0.5 \\ 0.5 & -0.5 \end{bmatrix} \begin{bmatrix} l(n) \\ r(n) \end{bmatrix}. \quad \text{(Equation 2)}$$

M-signal encoder 106 encodes the M signal inputted from down-mixer 105 and outputs the encoding result (M-signal encoding information) to multiplexer 112. Further, M-signal encoder 106 decodes an encoding result and outputs obtained decoded M signal M' to adder 107.

Note that, M-signal encoder 106 may determine (e.g., add) the number of encoding bits for the M signal based on the information indicating the number of extra bits inputted from entropy encoder 103.

Adder 107 calculates residual signal $E_m$ that is a difference (or encoding error) between the M signal inputted from down-mixer 105 and the decoded M signal inputted from M-signal encoder 106, and outputs the residual signal to residual encoder 111.

M-signal energy calculator 108 calculates energy $M_{Ene}$ of the M signal using the M signal inputted from down-mixer 105, and outputs energy $M_{Ene}$ to M-S predictor 109.

M-S predictor 109 predicts the S signal using the M signal inputted from down-mixer 105, the energy of the M signal inputted from M-signal energy calculator 108, and the decoded prediction parameter (decoded energy difference) inputted from inverse quantizer 104.

For example, M-S predictor 109 calculates prediction S signal $S^{-}$ in accordance with following Equation 3:

[3]

$$S^{-}_{b} = H_b M_b \quad \text{(Equation 3).}$$

In Equation 3, "b" denotes a subband number, "$M_b$" denotes the M signal at subband b, and "$H_b$" denotes a frequency response at subband b. Frequency response $H_b$ is expressed by, for example, following Equation 4:

[4]

$$H_b = \frac{E(S_b M_b)}{E(M_{Ene})} = \frac{E(L_b^2) - E(R_b^2)}{4E(M_b M_b^H)} = \frac{d_E(b)}{4E(M_b^2)}. \quad \text{(Equation 4)}$$

In Equation 4, "$L_b$" denotes the L signal at subband b, "$R_b$" denotes the R signal at subband b, and "$d_E(b)$" denotes a decoded energy difference at subband b. In addition, function E(x) is a function that returns the expected value of x.

That is, M-S predictor 109 calculates prediction S signal $S^{\sim}_b$ by multiplying the M signal (corresponding to $M_b$ in Equation 3) by the ratio (corresponding to $H_b$ in Equations 3 and 4) between the decoded energy difference (corresponding to $d_E(b)$ in Equation 4) that is the prediction parameter inputted from inverse quantizer 104, on the one hand, and the energy of the M signal inputted from M-signal energy calculator 108 (corresponding to $M_b^2$ in Equation 4), on the other hand.

Note that, Equation 3 represents the prediction S signal ($S^{\sim}_b$) for each subband b by way of example, but is not limited to this. For example, M-S predictor 109 may calculate the prediction S signal for each group of a plurality of subbands, may calculate the prediction S signal for the entire band in the frequency domain, or may calculate the prediction S signal in the time domain.

M-S predictor 109 outputs the obtained prediction S signal to adder 110.

Adder 110 calculates residual signal $E_s$ that is a difference (or encoding error) between the S signal inputted from down-mixer 105 and the prediction S signal inputted from M-S predictor 109, and outputs the residual signal to residual encoder 111.

Residual encoder 111 encodes residual signal $E_m$ inputted from adder 107 and residual signal $E_s$ inputted from adder 110, and outputs an encoding result (residual encoding information) to multiplexer 112. For example, residual encoder 111 may encode a combination of residual signal $E_m$ and residual signal $E_s$.

Residual encoder 111 may determine (e.g., add) the number of encoding bits for the residual signals based on the information indicating the number of extra bits inputted from entropy encoder 103.

Multiplexer 112 multiplexes together the prediction-parameter encoding information inputted from entropy encoder 103, the M-signal encoding information inputted from M-signal encoder 106, and the residual encoding information inputted from residual encoder 111. Multiplexer 112 transmits an obtained bit stream to decoder 200 via a transport layer or the like, for example.

[Configuration of Decoder]

Figure 3:
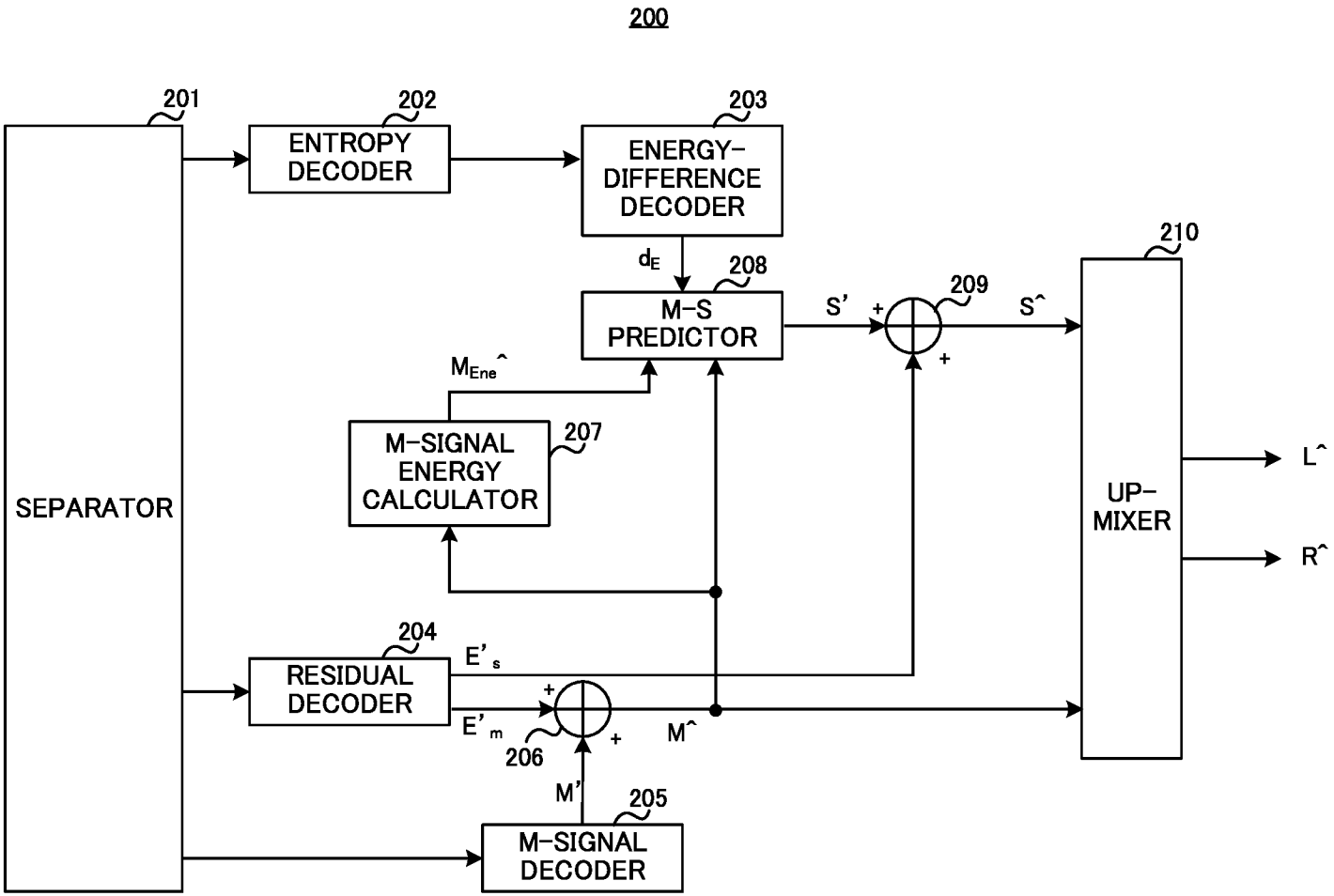
FIG. 3 is a block diagram illustrating a configuration example of a decoder according to Embodiment 1.

FIG. 3 is a block diagram illustrating a configuration example of decoder 200 according to the present embodiment. In FIG. 3, decoder 200 includes separator 201, entropy decoder 202, energy-difference decoder 203, residual decoder 204, M-signal decoder 205, adder 206, M-signal energy calculator 207, M-S predictor 208, adder 209, and up-mixer 210.

FIG. 3 illustrates that the bit stream transmitted from encoder 100 is inputted to separator 201. For example, the bit stream includes the multiplexed prediction-parameter encoding information, M-signal encoding information, and residual encoding information. Separator 201 separates the prediction-parameter encoding information, the M-signal encoding information, and the residual encoding information from the inputted bit stream. Separator 201 outputs the prediction-parameter encoding information to entropy decoder 202, outputs the residual encoding information to residual decoder 204, and outputs the M-signal encoding information to M-signal decoder 205.

Entropy decoder 202 decodes the prediction-parameter encoding information inputted from separator 201 and outputs a decoded quantization index to energy-difference decoder 203.

Energy-difference decoder 203 decodes the decoded quantization index inputted from entropy decoder 202, and outputs the obtained decoded prediction parameter (decoded energy difference $d_E$) to M-S predictor 208.

Residual decoder 204 decodes the residual encoding information inputted from separator 201, and obtains decoded residual signal $E_m'$ of the M signal and decoded residual signal $E_s'$ of the S signal. Residual decoder 204 outputs decoded residual signal $E_m'$ to adder 206 and decoded residual signal $E_s'$ to adder 209.

M-signal decoder 205 decodes the M-signal encoding information inputted from separator 201 and outputs decoded M signal M' to adder 206.

Adder 206 adds together decoded residual signal $E_m'$ inputted from residual decoder 204 and decoded M signal M' inputted from M-signal decoder 205, and outputs, to M-signal energy calculator 207, M-S predictor 208, and up-mixer 210, decoded M signal M^ that is the result of addition.

M-signal energy calculator 207 calculates energy $M_{Ene}$^ of the M signal using decoded M signal M^ inputted from adder 206, and outputs energy $M_{Ene}$^ to M-S predictor 208.

M-S predictor 208 predicts the S signal using decoded M signal M^ inputted from adder 206, energy $M_{Ene}$^ of the M signal inputted from M-signal energy calculator 207, and decoded energy difference $d_E$ inputted from energy-difference decoder 203.

For example, like M-S predictor 109, M-S predictor 208 calculates prediction S signal S' by multiplying decoded M signal M^ (corresponding to $M_b$ in Equation 3) by the ratio (corresponding to $H_b$ in Equation 3 and Equation 4) between decoded energy difference $d_E$ (corresponding to $d_E(b)$ in Equation 4) and energy $M_{Ene}$^ (corresponding to $M_b^2$ in Equation 4) of the M signal in accordance with Equation 3 and Equation 4.

M-S predictor 208 outputs prediction S signal S' to adder 209.

Adder 209 adds together decoded residual signal $E_s'$ inputted from residual decoder 204 and prediction S signal S' inputted from M-S predictor 208, and outputs, to up-mixer 210, decoded S signal S^ that is the result of addition.

Up-mixer 210 converts decoded M signal M^ inputted from adder 206 and decoded S signal S^ inputted from adder 209 into decoded L signal L^ and decoded R signal R^(MS-LR conversion). For example, up-mixer 210 converts the decoded M signal and the decoded S signal into the decoded L signal and the decoded R signal in accordance with Equation 5:

[5]

$$\begin{bmatrix} \hat{L}(f) \\ \hat{R}(f) \end{bmatrix} = \begin{bmatrix} 1 & 1 \\ 1 & -1 \end{bmatrix} \begin{bmatrix} \hat{M}(f) \\ \hat{S}(f) \end{bmatrix}. \quad \text{(Equation 5)}$$

Note that, while Equation 5 represents the MS-LR conversion in the frequency domain (at frequency f), up-mixer 210 may also perform the MS-LR conversion in the time domain (at time n) as shown by Equation 6, for example:

[6]

$$\begin{bmatrix} \hat{l}(n) \\ \hat{r}(n) \end{bmatrix} = \begin{bmatrix} 1 & 1 \\ 1 & -1 \end{bmatrix} \begin{bmatrix} \hat{m}(n) \\ \hat{s}(n) \end{bmatrix}. \quad \text{(Equation 6)}$$

Encoder 100 and decoder 200 according to the present embodiment have been described above.

In the present embodiment, encoder 100 calculates the energy difference between the L and R signals as the prediction parameter for predicting the S signal. It is thus possible for encoder 100 to calculate the prediction S signal using the stereo signal (energy of the L signal and the R signal) inputted to encoder 100 without calculating a cross correlation between the M signal and the S signal for prediction of the S signal.

Therefore, encoder 100 can reduce the calculation amount for calculating the prediction S signal in MS predictive encoding. Thus, according to the present embodiment, it is possible to efficiently encode the S signal in the MS predictive encoding.

Moreover, encoder 100 performs entropy encoding on the prediction parameter (quantization index) indicating the energy difference between the L and R signals in the present embodiment. For example, a code length is variable in the entropy encoding. Thus, when there are bits (extra bits) that have not been used in encoding of the prediction parameter, encoder 100 can add the extra bits for encoding the M signal or the residual signal. That is, encoder 100 is capable of encoding the M signal or the residual signal using the extra bits obtained by entropy encoding in addition to bits assigned to each encoder. Therefore, according to the present embodiment, it is possible to enhance the quantization performance of encoder 100 for quantization of the M signal or the residual signal, and to achieve a high-quality decoded stereo signal in decoder 200.

In addition, encoder 100 encodes residual signal $E_m$ of the M signal and transmits it to decoder 200 in the present embodiment. Then, decoder 200 generates, using residual signal $E_m$ (decoded residual signal) of the M signal, decoded M signal M' used for calculating the prediction S signal. For example, it is probable that a greater encoding error of the M signal results in a greater prediction error of the S signal, so as to cause degradation in the quality of the S signal. In contrast, the present embodiment makes it possible to reduce the encoding error of the M signal and, thus, to reduce the prediction error of the S signal by including the residual signal of the M signal in the encoding information. Accordingly, it is possible to improve the quality of the S signal.

Further, encoder 100 encodes residual signal $E_s$ of the prediction S signal and transmits it to decoder 200 in the present embodiment. Then, decoder 200 generates decoded S signal S' using residual signal $E_s$ (decoded residual signal) of the prediction S signal. The present embodiment thus makes it possible to reduce the prediction error of the S signal by including the residual signal of the prediction S signal in the encoding information. Accordingly, it is possible to improve the quality of the S signal.

Note that, the present embodiment has been described in which the residual signal of the M signal and the residual signal of the S signal are transmitted from encoder 100 to decoder 200. However, at least one of the residual signal of the M signal and the residual signal of the S signal may not be transmitted from encoder 100 to decoder 200. For example, decoder 200 may decode (predict) the S signal based on the M-signal encoding information and the prediction-parameter encoding information (for example, the energy difference) transmitted from encoder 100.

Note also that, the present embodiment has been described in which M-signal energy calculator 108 and M-S predictor 109 calculate the energy of the M signal and the prediction S signal, respectively, using the M signal in encoder 100 illustrated in FIG. 2, but the present invention is not limited thereto. For example, encoder 100 may calculate the energy of the M signal and the prediction S signal using the decoded M signal outputted from M-signal encoder 106. As is understood, encoder 100 can generate the prediction S signal under the same conditions as decoder 200 by using the decoded M signal that is used in decoder 200 to calculate the energy of the M signal and the prediction S signal. That is, the difference signal between the actual S signal (S in encoder 100) and the M-S prediction signal S~ in the decoder can be encoded as residual signal $E_s$, and accordingly, it is possible to reduce the encoding error of the S signal.

Alternatively, encoder 100 may add together decoded residual signal $E'_m$, obtained by decoding residual signal $E_m$ of the M signal (for example, the output of residual encoder 111) and decoded M signal M' (for example, the output of M-signal encoder 106) to generate decoded M signal M^ and calculate the energy of the M signal and the prediction S signal using decoded M signal MA. This makes it possible for encoder 100 to further increase the prediction accuracy for prediction of the S signal. In this case, however, encoder 100 encodes residual signal $E_s$ and residual signal $E_m$ without combining them together because decoded residual signal $E'_m$ is required for calculation of residual signal $E_s$.

Embodiment 2

Embodiment 1 has been described in which the prediction parameter used for calculating the prediction S signal is calculated using the energy difference between the L signal and the R signal of the stereo signal. Unlike such an embodiment, the present embodiment will be described in which the prediction parameter used for calculating the prediction S signal is calculated using the M signal and S signal.

[Configuration of Encoder]

Figure 4:
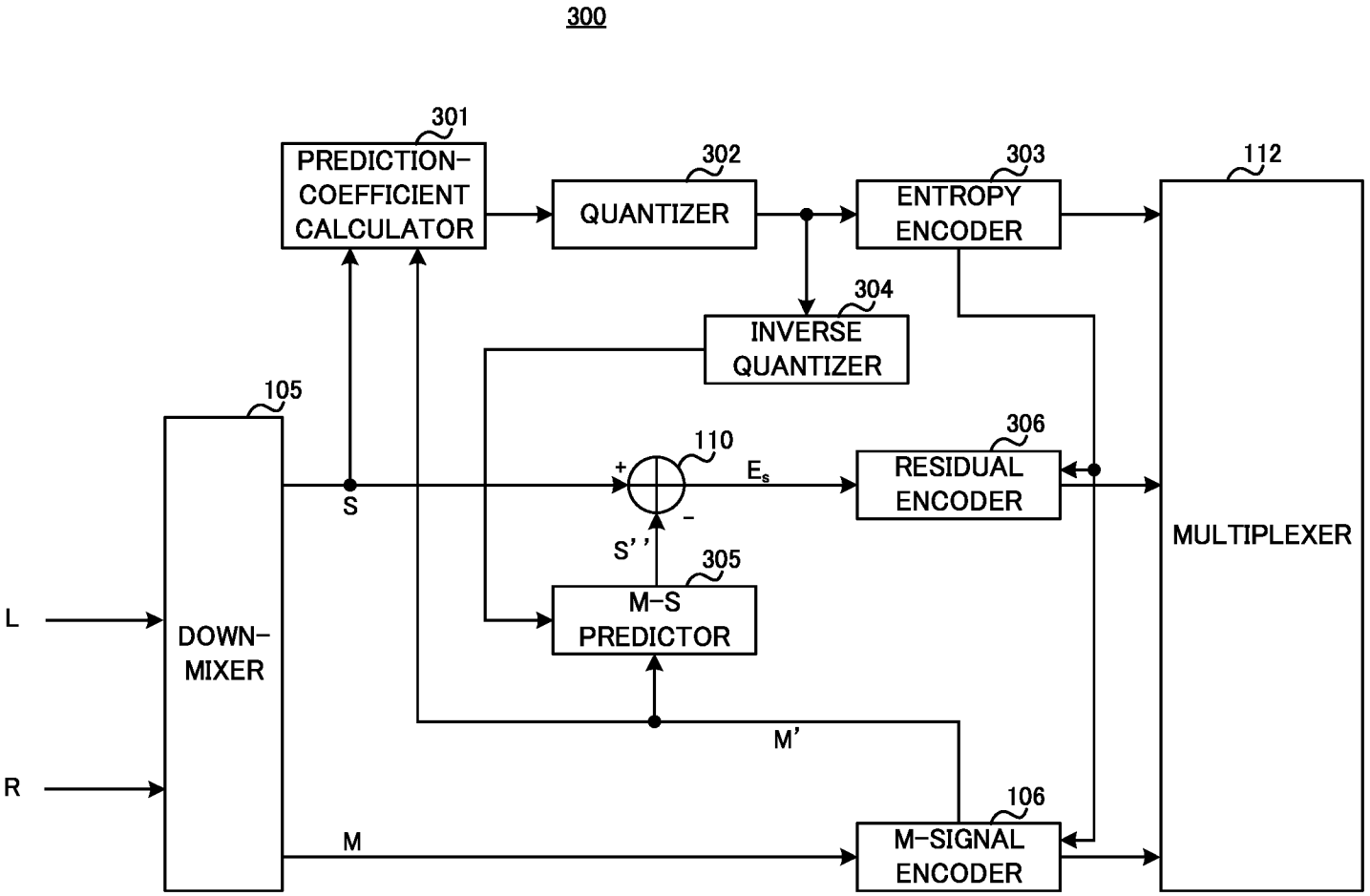
FIG. 4 is a block diagram illustrating a configuration example of an encoder according to Embodiment 2.

FIG. 4 is a block diagram illustrating a configuration example of encoder 300 according to the present embodiment. Note that, the same components between FIG. 4 and Embodiment 1 (FIG. 2) are provided with the same reference symbols, and descriptions of such components are omitted.

Prediction-coefficient calculator 301 calculates an M-S prediction coefficient using an S signal inputted from down-mixer 105 and a decoded M signal inputted from M-signal encoder 106. Prediction-coefficient calculator 301 outputs the calculated M-S prediction coefficient to quantizer 302 as a prediction parameter for predicting the S signal.

For example, prediction-coefficient calculator 301 calculates the M-S prediction coefficient in accordance with following Equation 7:

[7]

$$H_b = \frac{E(S_b M'_b)}{E(M'_{Ene}(b))}. \quad \text{(Equation 7)}$$

In Equation 7, "$S_b$" denotes the S signal at subband b, "$M'_b$" denotes the decoded M signal at subband b, and "$M'_{Ene}(b)$" denotes the energy of the decoded M signal at subband b. In addition, function E(x) is a function that returns the expected value of x.

For example, the numerator component of Equation 7 is calculated in accordance with following Equation 8:

[8]

$$E(S_b M'_b) = \sum_{k=k_{start}(b)}^{k=K_{end}(b)-1} S(k)M'^*(k), \quad \text{(Equation 8)}$$

$$b = 0, \ldots, N_{bands} - 1.$$

Further, for example, energy $M'_{Ene}(b)$ of the decoded M signal shown in Equation 7 is calculated in accordance with following Equation 9:

[9]

$$E(M'_{Ene}(b)) = \sum_{k=k_{start}(b)}^{k=K_{end}(b)-1} M'(k)M'^*(k), \quad \text{(Equation 9)}$$

$$b = 0, \ldots, N_{bands} - 1.$$

In Equations 8 and 9, "$k_{start}$" denotes the starting number of the spectral coefficient at subband b, and "$k_{end}$" denotes the ending number of the spectral coefficient at subband b. Further, "$N_{bands}$" denotes the number of subbands. In addition, "*" denotes a complex conjugate.

That is, the M-S prediction coefficient (prediction parameter) shown in Equation 7 is a coefficient obtained by normalizing a correlation value between decoded M signal M' and S signal S by energy $M'_{Ene}$ of the decoded M signal. Here, since the M and S signals are the sum and difference of the L and R signals, the correlation value between the M and S signals is equal to the energy difference between the L and R signals. Accordingly, the M-S prediction coefficient (prediction parameter) shown in Equation 7 is a parameter relating to the energy difference between the L signal and the R signal, but including an error corresponding to the encoding error between the M signal and the decoded M signal.

Quantizer 302 performs scalar quantization on the prediction parameter inputted from prediction-coefficient calculator 301, and outputs the obtained quantization index to entropy encoder 303 and inverse quantizer 304.

Entropy encoder 303 performs entropy encoding (for example, Huffman encoding or the like) on the quantization index inputted from quantizer 302, and outputs the encoding result (prediction-parameter encoding information) to multiplexer 112.

Further, entropy encoder 303 calculates the number of bits necessary for the encoding result, and outputs information indicating a difference (the number of extra bits) between the maximum number of bits available for the encoding result and the calculated number of bits (in other words, information indicating by what number of bits the number of necessary bits is smaller than the maximum number of bits) to at least one of M-signal encoder 106 and residual encoder 306. At least one of M-signal encoder 106 and residual encoder 306 may encode the M signal and the residual signal based on, for example, information indicating the number of extra bits.

Inverse quantizer 304 decodes the quantization index inputted from quantizer 302 and outputs the obtained decoded prediction parameter (decoded M-S prediction coefficient) to M-S predictor 305.

M-S predictor 305 predicts the S signal using the decoded M signal inputted from M-signal encoder 106 and the decoded prediction parameter (decoded M-S prediction coefficient) inputted from inverse quantizer 304.

For example, M-S predictor 305 calculates prediction S signal S" in accordance with following Equation 10:

[10]

$$S''_b = H_b M'_b \quad \text{(Equation 10).}$$

In Equation 10, "b" denotes a subband number, "$M'_b$" denotes the decoded M signal at subband b, and "$H_b$" denotes the M-S prediction coefficient at subband b (see Equation 7).

That is, M-S predictor 305 calculates prediction S signal $S''_b$ by multiplying the decoded M signal (corresponding to $M'_b$ in Equation 7) by the ratio (corresponding to $H_b$ in Equation 7) between the correlation value (corresponding to $S_b M'_b$ in Equation 7) between the decoded M signal and the S signal, on the one hand, and the energy (corresponding to $M'_{Ene}$ in Equation 7) of the decoded M signal, on the other hand.

Residual encoder 306 encodes residual signal $E_s$ of the S signal inputted from adder 110, and outputs the encoding result (residual encoding information) to multiplexer 112.

[Configuration of Decoder]

Figure 5:
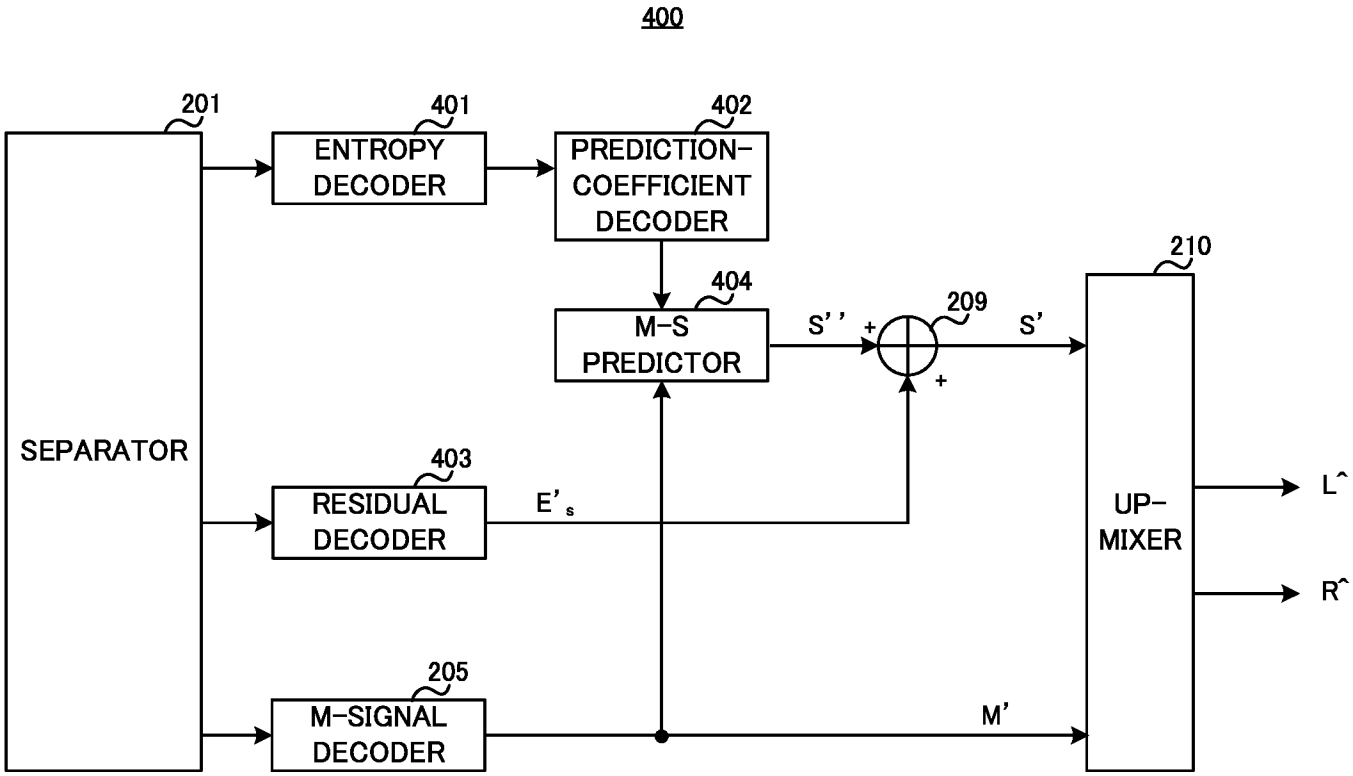
FIG. 5 is a block diagram illustrating a configuration example of a decoder according to Embodiment 2.

FIG. 5 is a block diagram illustrating a configuration example of decoder 400 according to the present embodiment. Note that, the same components between FIG. 5 and Embodiment 1 (e.g., FIG. 3) are provided with the same reference symbols, and descriptions of such components are omitted.

Entropy decoder 401 decodes the prediction-parameter encoding information inputted from separator 201 and outputs the decoded quantization index to prediction-coefficient decoder 402.

Prediction-coefficient decoder 402 decodes the decoded quantization index inputted from entropy decoder 401 and outputs the obtained decoded prediction parameter (decoded M-S prediction coefficient) to M-S predictor 404.

Residual decoder 403 decodes the residual encoding information inputted from separator 201, and obtains decoded residual signal $E_s'$ of the S signal. Residual decoder 403 outputs decoded residual signal $E_s'$ to adder 209.

M-S predictor 404 predicts the S signal using decoded M signal M' inputted from M-signal decoder 205 and the decoded M-S prediction coefficient inputted from prediction-coefficient decoder 402.

For example, like M-S predictor 305, M-S predictor 404 calculates prediction S signal $S_b''$ by multiplying decoded M signal $M'_b$ by M-S prediction coefficient $H_b$ in accordance with Equation 10.

Encoder 300 and decoder 400 according to the present embodiment have been described above.

Here, in decoder 400 illustrated in FIG. 5, M-S predictor 404 calculates prediction S signal S" using the decoded M-S prediction coefficient and the decoded M signal. In this respect, in encoder 300 illustrated in FIG. 4, M-S predictor 305 calculates prediction S signal S" using the decoded M-S prediction coefficient and the decoded M signal. In addition, in encoder 300, prediction-coefficient calculator 301 calculates the M-S prediction coefficient using the decoded M signal.

As is understood, in the present embodiment, encoder 300 uses, in both the calculation processing of the M-S prediction coefficient and the prediction processing of the S signal, the decoded M signal that is also used in decoder 400. In other words, encoder 300 performs the prediction processing on the S signal under the same conditions as the prediction processing on the S signal by decoder 400; that is, reproduces the processing of decoder 400.

It is thus possible for encoder 300 to perform the MS predictive encoding considering the encoding error of the M signal, so as to enhance the prediction accuracy of the MS predictive encoding for prediction of the S signal. Thus, according to the present embodiment, it is possible to efficiently encode the S signal in the MS predictive encoding. For example, the present embodiment is particularly effective for a low bit rate at which the encoding error (or encoding distortion) of the M signal is large.

Note that, in the present embodiment, prediction-coefficient calculator 301 of encoder 300 may calculate the M-S prediction coefficient using the M signal (for example, the output of down-mixer 105) instead of the decoded M signal. Also in this case, M-S predictor 305 of encoder 300 predicts the S signal using the decoded M signal and the decoded M-S prediction coefficient in the same manner as decoder 400. Thus, even when the M-S prediction coefficient calculated using the decoded M signal differs from the M-S prediction coefficient calculated using the M signal, for example, it is possible to include, in residual signal $E_s$ of the S signal, the prediction error caused by the difference in the prediction coefficient, so as to reduce degradation of quality of the decoded stereo signal.

Embodiment 3

Embodiments 1 and 2 have been described in which prediction of the S signal is performed using the M signal in predictive encoding. In contrast, the present embodiment will be described in which prediction of the L signal and the R signal is performed using the M signal in the predictive encoding. In other words, in the present embodiment, neither an encoder nor a decoder perform prediction of the S signal.

[Overview of Communication System]

A communication system according to the present embodiment includes encoder 500 and decoder 600.

[Configuration of Encoder]

Figure 6:
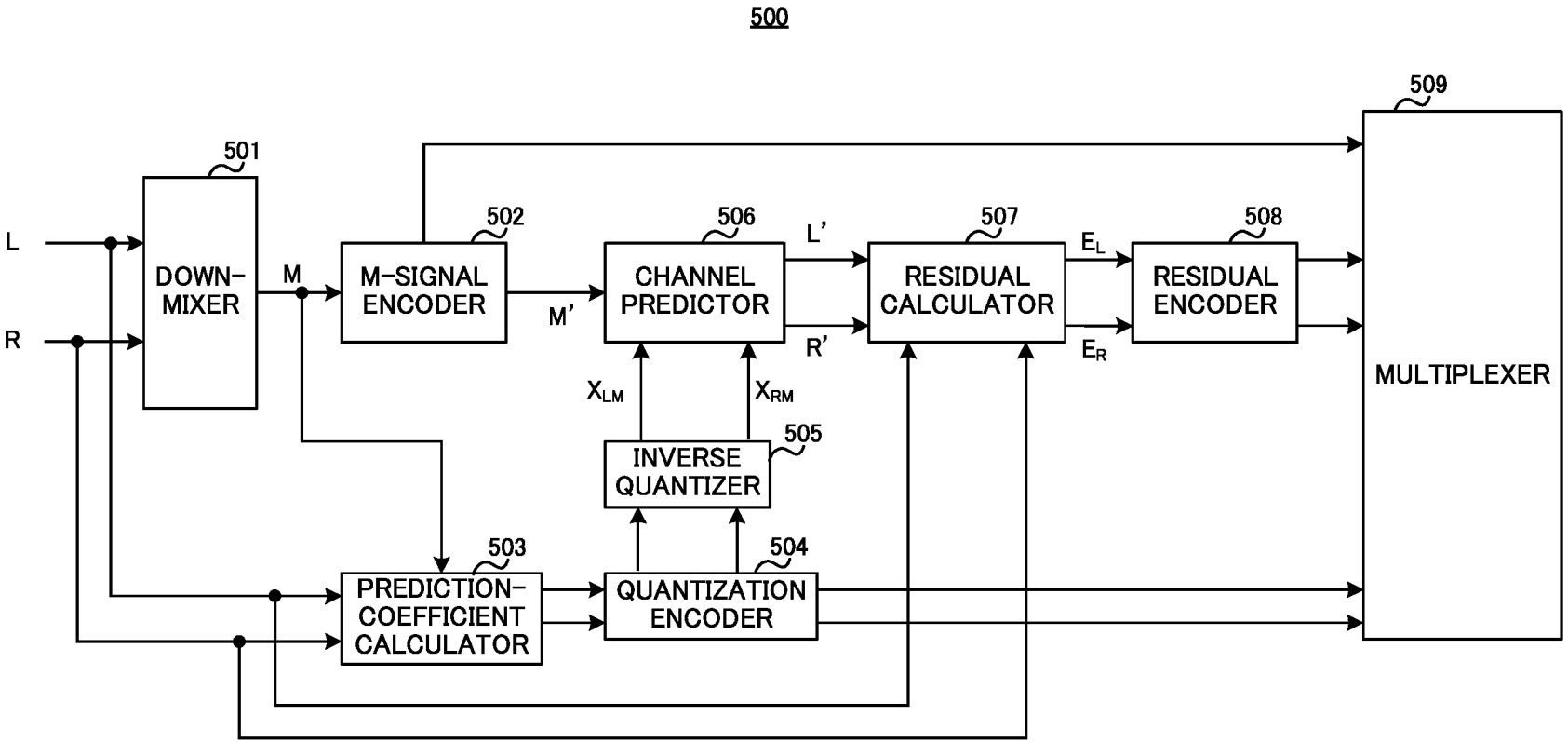
FIG. 6 is a block diagram illustrating a configuration example of an encoder according to Embodiment 3.

FIG. 6 is a block diagram illustrating a configuration example of encoder 500 according to the present embodiment. In FIG. 6, encoder 500 includes down-mixer 501, M-signal encoder 502, prediction-coefficient calculator 503, quantization encoder 504, inverse quantizer 505, channel predictor 506, residual calculator 507, residual encoder 508, and multiplexer 509.

FIG. 6 illustrates that an L signal and an R signal constituting a stereo signal are inputted to down-mixer 501, prediction-coefficient calculator 503, and residual calculator 507.

Down-mixer 501 converts the inputted L and R signals into an M signal (LR-M conversion). Down-mixer 501 outputs the M signal to M-signal encoder 502 and prediction-coefficient calculator 503. For example, down-mixer 501 converts the L signal and the R signal into the M signal in accordance with Equation 1 or Equation 2.

M-signal encoder 502 encodes the M signal inputted from down-mixer 501 and outputs an encoding result (M-signal encoding information) to multiplexer 509. Further, M-signal encoder 502 decodes the encoding result and outputs obtained decoded M signal M' to channel predictor 506.

Prediction-coefficient calculator 503 calculates an M-L prediction coefficient and an M-R prediction coefficient using the inputted L and R signals, and the M signal inputted from down-mixer 501. Prediction-coefficient calculator 503 outputs the calculated M-L and M-R prediction coefficients to quantization encoder 504 as prediction parameters for predicting the L signal and the R signal.

For example, prediction-coefficient calculator 503 calculates M-L prediction coefficient $X_{LM}(b)$ and M-R prediction coefficient $X_{RM}(b)$ for subband b in accordance with following Equations 11 and 12:

[11]

$$X_{LM}(b)=E(L_bM_b) \quad \text{(Equation 11);}$$

[12]

$$X_{RM}(b)=E(R_bM_b) \quad \text{(Equation 12).}$$

In Equations 11 and 12, "$L_b$" denotes the L signal at subband b, "$R_b$" denotes the R signal at subband b, and "$M_b$" denotes the M signal at subband b. In addition, function E(x) is a function that returns the expected value of x. That is, M-L prediction coefficient $X_{LM}$ denotes the correlation value between the L signal and the M signal, and M-R prediction coefficient $X_{RM}$ denotes the correlation value between the R signal and the M signal.

Quantization encoder 504 performs scalar quantization on the prediction parameters (M-L prediction coefficient and M-R prediction coefficient) inputted from prediction-coefficient calculator 503, performs encoding on obtained quantization indexes, and outputs an encoding result (prediction-parameter encoding information) to multiplexer 509. Further, quantization encoder 504 outputs the quantization indexes to inverse quantizer 505.

Inverse quantizer 505 decodes the quantization indexes inputted from quantization encoder 504 and outputs the obtained decoded prediction parameters (the decoded M-L prediction coefficient and the decoded M-R prediction coefficient) to channel predictor 506.

Channel predictor 506 predicts the L signal and the R signal using the decoded prediction parameters (the decoded M-L prediction coefficient and the decoded M-R prediction coefficient) inputted from inverse quantizer 505 and the decoded M signal inputted from M-signal encoder 502. Channel predictor 506 outputs the prediction L signal and the prediction R signal to residual calculator 507.

For example, channel predictor 506 calculates prediction L signal L' in accordance with following Equations 13 and 14:

[13]

$$L'_b = H_b^L M'_b; \quad \text{(Equation 13)}$$

[14]

$$H_b^L = \frac{X_{LM}(b)}{E(M_{Ene}(b))}. \quad \text{(Equation 14)}$$

In Equation 13, "$H^L_b$" denotes a frequency response at subband b, and "$M'_b$" denotes the decoded M signal at subband b. Further, in Equation 14, "$M_{Ene}(b)$" denotes the energy of the decoded M signal at subband b. In addition, function E(x) is a function that returns the expected value of x.

Likewise, channel predictor 506 calculates prediction R signal R' in accordance with following Equations 15 and 16, for example:

[15]

$$R'_b = H^R_b M'_b; \quad \text{(Equation 15)}$$

[16]

$$H^R_b = \frac{X_{RM}(b)}{E(M_{Ene}(b))}. \quad \text{(Equation 16)}$$

In Equation 15, "$H^R_b$" denotes a frequency response at subband b, and "$M'_b$" denotes the decoded M signal at subband b. Further, in Equation 16, "$M_{Ene}(b)$" denotes the energy of the decoded M signal at subband b. In addition, function E(x) is a function that returns the expected value of x.

Residual calculator 507 calculates residual signal $E_L$, which is a difference between the inputted L signal and the prediction L signal inputted from channel predictor 506, and outputs the residual signal to residual encoder 508. Residual calculator 507 also calculates residual signal $E_R$, which is a difference between the inputted R signal and the prediction R signal inputted from channel predictor 506, and outputs the residual signal to residual encoder 508.

Residual encoder 508 encodes residual signal $E_L$ and residual signal $E_R$ inputted from residual calculator 507, and outputs the encoding result (residual encoding information) to multiplexer 509.

Multiplexer 509 multiplexes together the M-signal encoding information inputted from M-signal encoder 502, the prediction-parameter encoding information inputted from quantization encoder 504, and the residual encoding information inputted from residual encoder 508. Multiplexer 509 transmits an obtained bit stream to decoder 600 via a transport layer or the like, for example.

[Configuration of Decoder]

Figure 7:
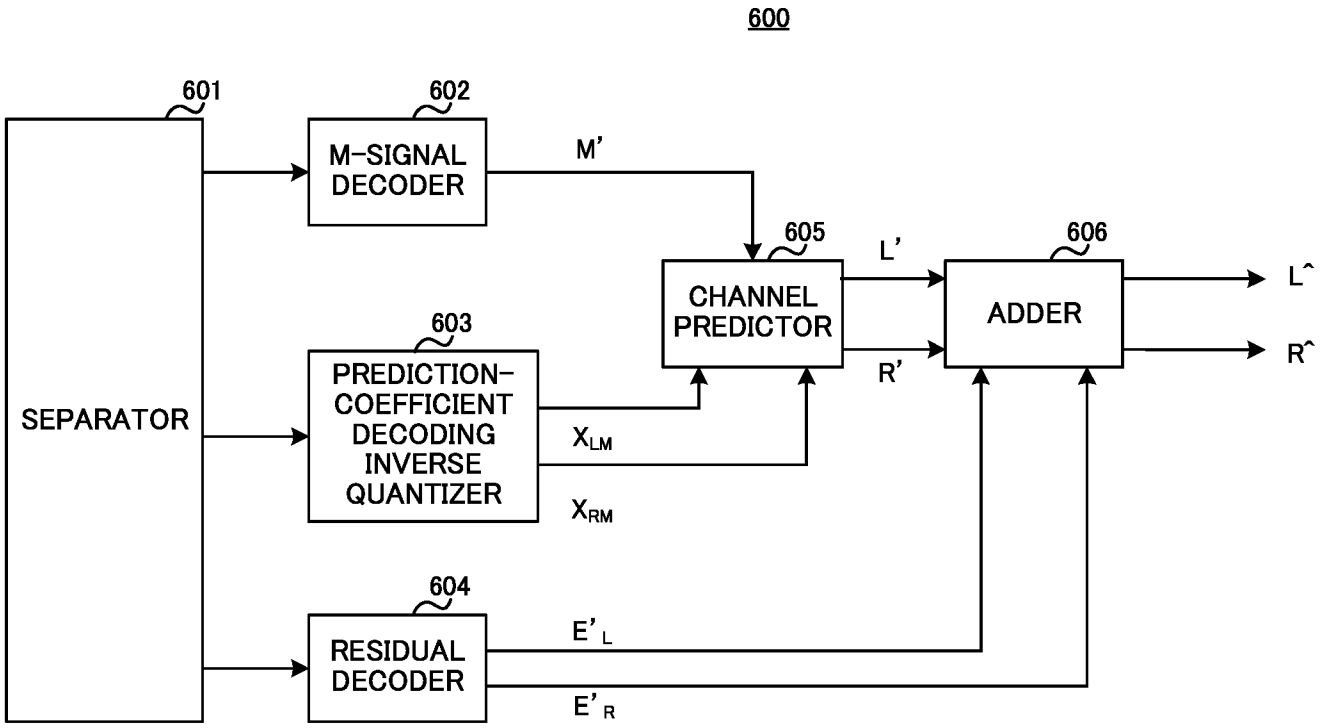
FIG. 7 is a block diagram illustrating a configuration example of a decoder according to Embodiment 3.

FIG. 7 is a block diagram illustrating a configuration example of decoder 600 according to the present embodiment. In FIG. 7, decoder 600 includes separator 601, M-signal decoder 602, prediction-coefficient decoding inverse quantizer 603, residual decoder 604, channel predictor 605, and adder 606.

In FIG. 7, the bit stream transmitted from encoder 500 is inputted to separator 601. For example, the bit stream includes the multiplexed prediction-parameter encoding information, M-signal encoding information, and residual encoding information.

Separator 601 separates the prediction-parameter encoding information, the M-signal encoding information, and the residual encoding information from the inputted bit stream. Separator 601 outputs the M-signal encoding information to M-signal decoder 602, outputs the prediction-parameter encoding information to prediction-coefficient decoding inverse quantizer 603, and outputs the residual encoding information to residual decoder 604.

M-signal decoder 602 decodes the M-signal encoding information inputted from separator 601 and outputs decoded M signal M' to channel predictor 605.

Prediction-coefficient decoding inverse quantizer 603 decodes the prediction-parameter encoding information inputted from separator 601, and outputs, to channel predictor 605, the decoded prediction parameters (decoded M-L prediction coefficient $X_{LM}$ and decoded M-R prediction coefficient $X_{RM}$) corresponding to a decoded quantization index.

Residual decoder 604 decodes the residual encoding information inputted from separator 601, and obtains decoded residual signal $E_L'$ of the L signal and decoded residual signal $E_R'$ of the R signal. Residual decoder 604 outputs decoded residual signal $E_L'$ and decoded residual signal $E_R'$ to adder 606.

Channel predictor 605 predicts the L signal and the R signal using the decoded M signal inputted from M-signal decoder 602 and the decoded prediction parameters (decoded M-L and M-R prediction coefficients) inputted from prediction-coefficient decoding inverse quantizer 603. Channel predictor 605 outputs the prediction L signal and the prediction R signal to adder 606.

For example, like channel predictor 506, channel predictor 605 calculates prediction L signal L' in accordance with Equations 13 and 14, and calculates prediction R signal R' in accordance with Equations 15 and 16.

Adder 606 adds together decoded residual signal $E_L'$ inputted from residual decoder 604 and the prediction L signal inputted from channel predictor 605, and outputs decoded L signal L^ that is the result of addition. Adder 606 also adds together decoded residual signal $E_R'$ inputted from residual decoder 604 and the prediction R signal inputted from channel predictor 605, and outputs decoded R signal R^ that is the result of addition.

Encoder 500 and decoder 600 according to the present embodiment have been described above.

As is understood, in the present embodiment, encoder 500 calculates the prediction parameters (M-L prediction coefficient and M-R prediction coefficient) using the M signal, the L signal, and the R signal when the predictive encoding of the L signal and the R signal is performed. In addition, encoder 500 predicts the L and R signals using the decoded M signal and the decoded prediction parameters. In other words, encoder 500 performs the prediction processing on the L signal and the R signal under the same conditions as the prediction processing on the L signal and the R signal by decoder 600, so as to reproduce the processing of decoder 600. It is thus possible for encoder 500 to perform channel predictive encoding considering the encoding error of the M signal, and the prediction errors and the encoding errors of the M-L prediction and the M-R prediction, so as to improve the encoding performance for encoding the L signal and the R signal in the channel predictive encoding.

Thus, according to the present embodiment, it is possible to efficiently encode the L signal and the R signal in the channel predictive encoding. For example, the present embodiment is particularly effective for a low bit rate at which the encoding error (or encoding distortion) of the M signal is large.

Note that, the description with reference to FIG. 6 has been given in relation to the case where prediction-coefficient calculator 503 calculates the M-L prediction coefficient and the M-R prediction coefficient using the M signal inputted from down-mixer 501. However, prediction-coefficient calculator 503 may also calculate the M-L prediction coefficient and the M-R prediction coefficient using the decoded M signal inputted from M-signal encoder 502 instead of the M signal. Thus, encoder 500 can calculate the prediction parameters using the decoded M signal that is to be used in decoder 600, so that it is possible to enhance the prediction accuracy of decoder 600 for predicting the L signal and the R signal.

Further, although the present embodiment has been described in relation to the encoding of the stereo signal (two-channel signal of the L channel and the R channel), a signal to be encoded is not limited to the stereo signal, and may also be a multi-channel signal (e.g., a signal of two or more channels).

Figure 8:
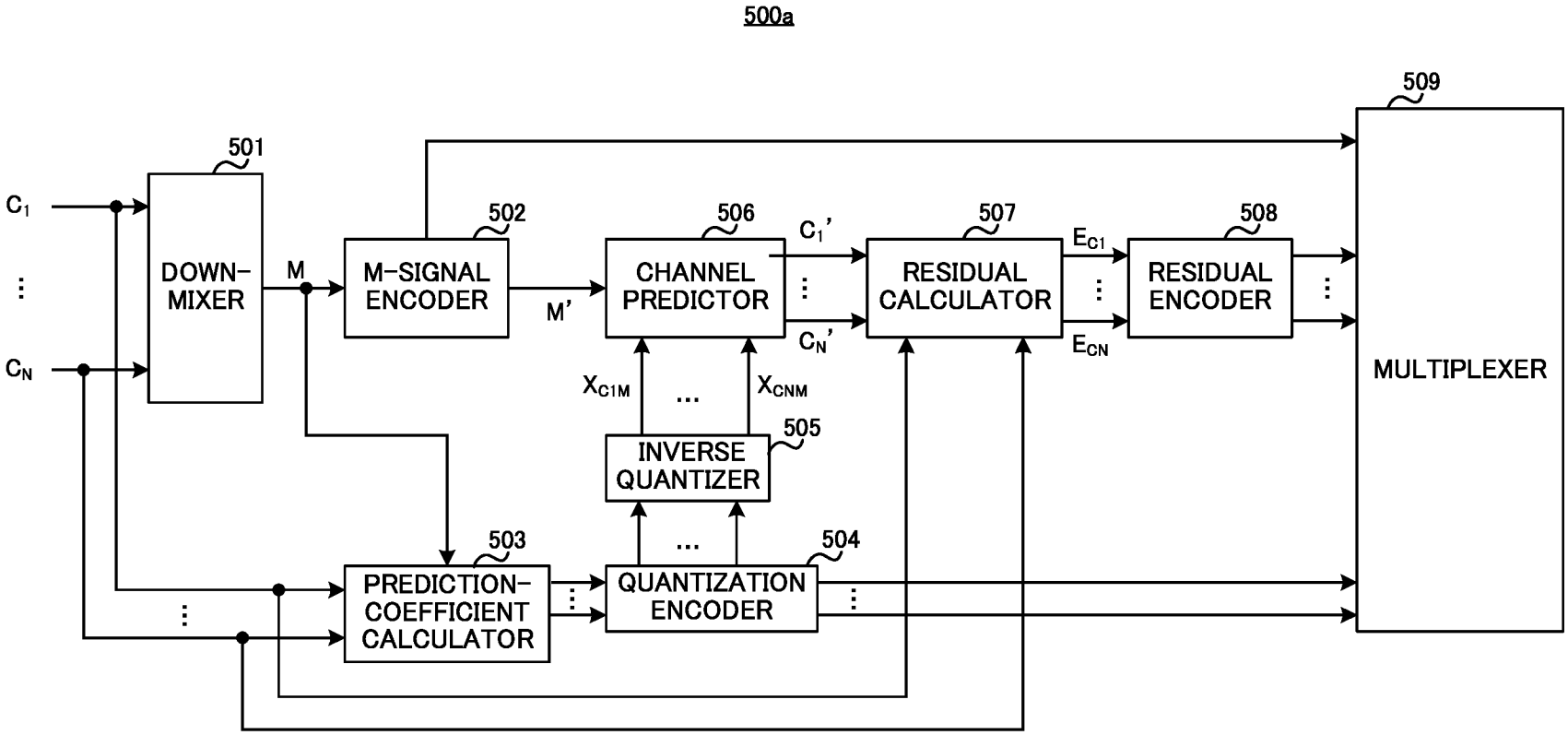
FIG. 8 is a block diagram illustrating another configuration example of the encoder according to Embodiment 3.
Figure 9:
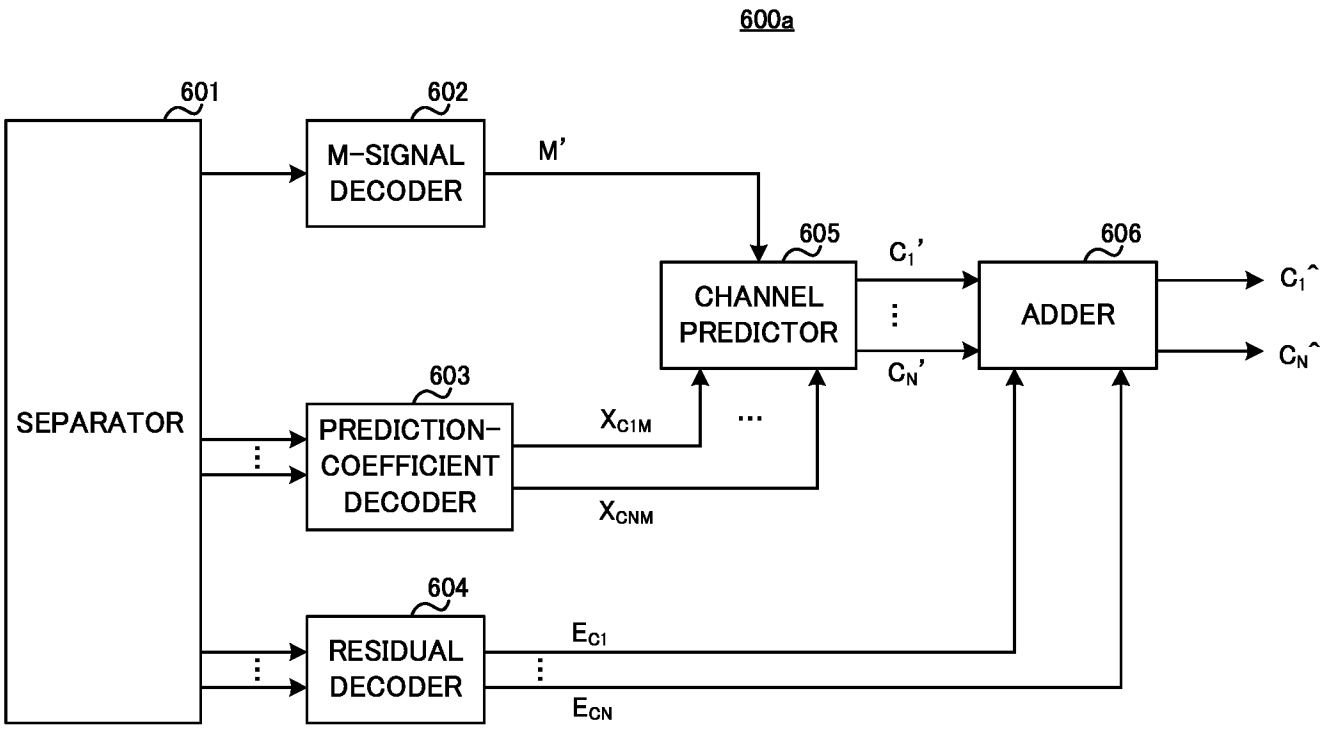
FIG. 9 is a block diagram illustrating another configuration example of the decoder according to Embodiment 3.

For example, FIG. 8 is a block diagram illustrating a configuration example of encoder 500*a* that encodes a multi-channel signal (N channels, where N is an integer of 2 or more), and FIG. 9 is a block diagram illustrating a configuration example of decoder 600*a* that decodes the multi-channel signal. The components of encoder 500*a* illustrated in FIG. 8 and decoder 600*a* illustrated in FIG. 9 perform the same processing as the components of encoder 500 illustrated in FIG. 6 and decoder 600 illustrated in FIG. 7. However, the processing in FIGS. 6 and 7 differs from the processing in FIGS. 8 and 9 in that the processing on two channels of the L signal and the R signal constituting the stereo signal is performed in FIGS. 6 and 7, whereas the processing on the N channels is performed in FIGS. 8 and 9. That is, encoder 500*a* and decoder 600*a* predict each channel signal using the M signal or the decoded M signal.

Embodiment 4

The present embodiment will be described in relation to a method of switching an encoding mode used for encoding a stereo signal among a plurality of encoding modes including the MS predictive encoding.

[Overview of Communication System]

A communication system according to the present embodiment includes encoder 700 and decoder 800.

[Configuration of Encoder]

Figure 10:
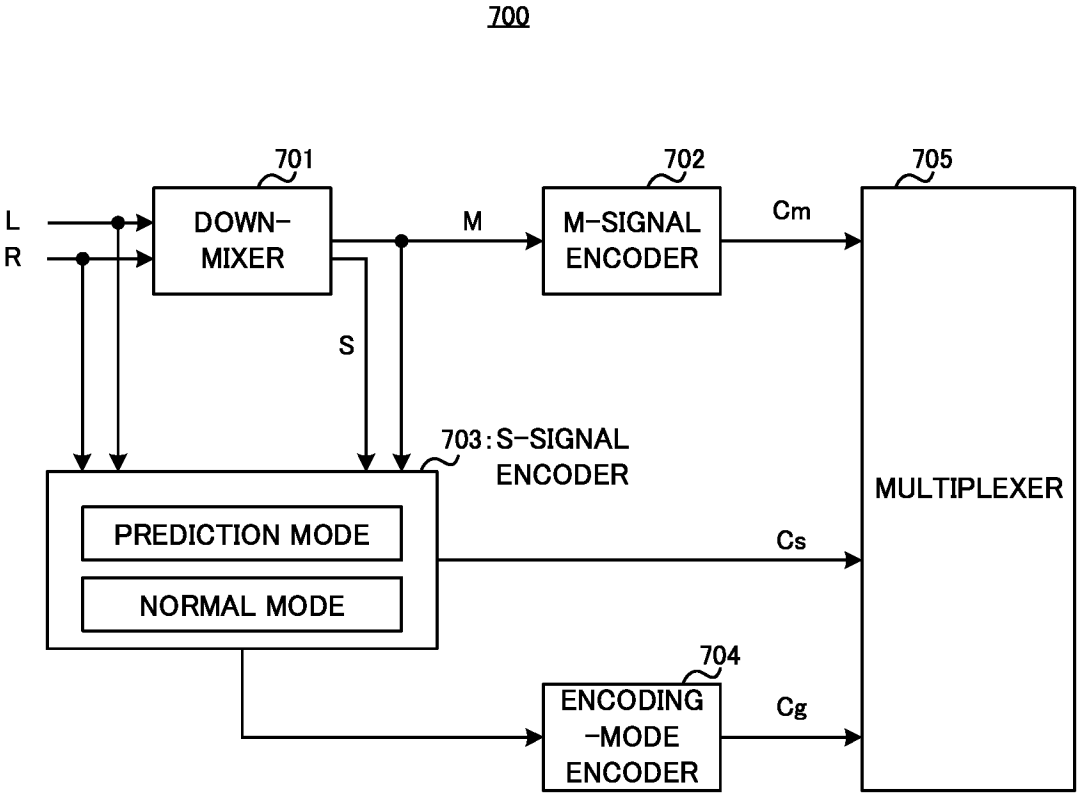
FIG. 10 is a block diagram illustrating a configuration example of an encoder according to Embodiment 4.

FIG. 10 is a block diagram illustrating a configuration example of encoder 700 according to the present embodiment. In FIG. 10, encoder 700 includes down-mixer 701, M-signal encoder 702, S-signal encoder 703, encoding-mode encoder 704, and multiplexer 705.

FIG. 10 illustrates that an L signal (Left channel signal) and an R signal (Right channel signal) constituting a stereo signal are inputted to down-mixer 701 and S-signal encoder 703.

Down-mixer 701 converts the inputted L and R signals into an M signal and an S signal (LR-MS conversion). Down-mixer 701 outputs the M signal to M-signal encoder 702 and S-signal encoder 703 and outputs the S signal to S-signal encoder 703. For example, down-mixer 701 converts the L signal and the R signal into the M signal and the S signal in accordance with Equation 1 or 2.

M-signal encoder 702 encodes the M signal inputted from down-mixer 701 and outputs encoding result (M-signal encoding information) Cm to multiplexer 705.

S-signal encoder 703 encodes the S signal using at least one of the inputted L and R signals, and the M signal and S signal inputted from down-mixer 701. S-signal encoder 703 outputs encoding result (S-signal encoding information) Cs to multiplexer 705.

For example, S-signal encoder 703 encodes the S signal using both a "prediction mode" in which M-S predictive encoding is performed and a "normal mode" in which normal encoding is performed. S-signal encoder 703 compares the encoding result of the prediction mode with the encoding result of the normal mode to select the encoding mode achieving a better encoding result, and outputs S-signal encoding information Cs including the encoding result of the selected encoding mode to multiplexer 705. S-signal encoder 703 also outputs information indicating the selected encoding mode to encoding-mode encoder 704.

In the "prediction mode," S-signal encoder 703 encodes the S signal as described, for example, in Embodiment 1 (for example, see FIG. 2) or Embodiment 2 (for example, see FIG. 4). When the prediction mode is selected as the encoding mode, S-signal encoder 703 outputs the prediction-parameter encoding information and the residual encoding information to multiplexer 705 as S-signal encoding information Cs.

Further, in the "normal mode," S-signal encoder 703 performs mono encoding on the S signal, for example, in an M/S stereo codec. When the normal mode is selected as the encoding mode, S-signal encoder 703 outputs the mono encoding result of encoding of the S signal to multiplexer 705 as S-signal encoding information Cs.

For example, S-signal encoder 703 may select an encoding mode achieving an encoding result with a smaller encoding error from among the prediction mode and the normal mode. Alternatively, S-signal encoder 703 may select an encoding mode achieving an encoding result requiring a smaller number of bits from among the prediction mode and the normal mode. Note that, the selection criterion for selecting the encoding mode is not limited to the encoding error or the number of encoding bits, and may also be another criterion relevant to the encoding performance.

Encoding-mode encoder 704 encodes the encoding mode inputted from S-signal encoder 703, and outputs obtained mode encoding information Cg to multiplexer 705.

Multiplexer 705 multiplexes together the M-signal encoding information inputted from M-signal encoder 702, the S-signal encoding information inputted from S-signal encoder 703, and the mode encoding information inputted from encoding-mode encoder 704. Multiplexer 705 transmits an obtained bit stream to decoder 800 via a transport layer or the like, for example.

[Configuration of Decoder]

Figure 11:
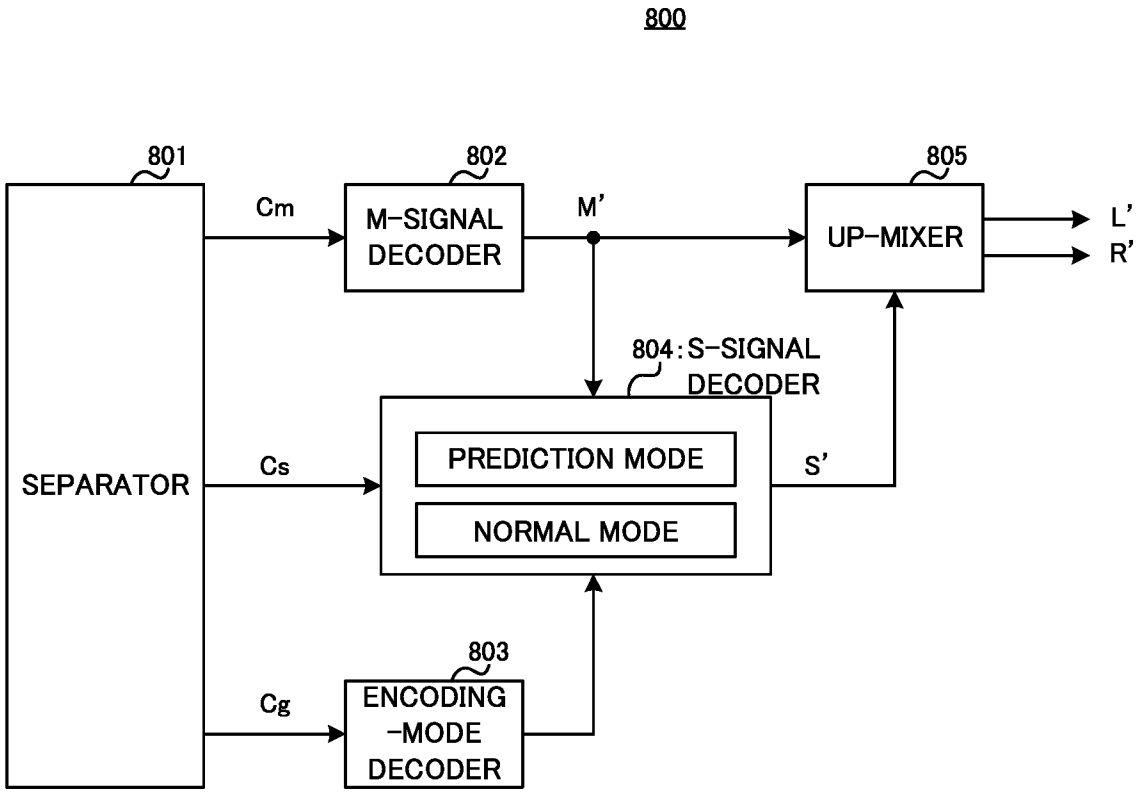
FIG. 11 is a block diagram illustrating a configuration example of a decoder according to Embodiment 4.

FIG. 11 is a block diagram illustrating a configuration example of decoder 800 according to the present embodiment. In FIG. 11, decoder 800 includes separator 801, M-signal decoder 802, encoding-mode decoder 803, S-signal decoder 804, and up-mixer 805.

In FIG. 11, the bit stream transmitted from encoder 700 is inputted to separator 801. For example, the bit stream includes multiplexed M-signal encoding information Cm, S-signal encoding information Cs, and mode encoding information Cg.

Separator 801 separates the M-signal encoding information, the S-signal encoding information, and the mode encoding information from the inputted bit stream. Separator 801 outputs the M-signal encoding information to M-signal decoder 802, outputs the mode encoding information to encoding-mode decoder 803, and outputs the S-signal encoding mode to S-signal decoder 804.

M-signal decoder 802 decodes the M-signal encoding information inputted from separator 801 and outputs decoded M signal M' to S-signal decoder 804 and up-mixer 805.

Encoding-mode decoder 803 decodes the mode encoding information inputted from separator 801, and outputs obtained information indicating the encoding mode to S-signal decoder 804.

S-signal decoder 804 decodes the S-signal encoding information and obtains decoded S signal S' based on the encoding mode inputted from encoding-mode decoder 803. S-signal decoder 804 outputs the decoded S signal to up-mixer 805.

When the encoding mode is the "prediction mode," S-signal decoder 804 predicts and decodes the S signal using the decoded M signal inputted from M-signal decoder 802 and the S-signal encoding information (prediction parameter and residual signal) inputted from separator 801, for example, as described in Embodiment 1 (for example, see FIG. 3) or Embodiment 2 (for example, see FIG. 5).

Alternatively, when the encoding mode is the "normal mode," S-signal decoder 804 performs mono decoding, for example, on the S-signal encoding information to obtain the decoded S signal.

Up-mixer 805 converts decoded M signal M' inputted from M-signal decoder 802 and decoded S signal S' inputted from S-signal decoder 804 into decoded L signal L' and decoded R signal R' (MS-LR conversion). For example, up-mixer 805 converts the decoded M signal and the decoded S signal into the decoded L signal and the decoded R signal in accordance with Equation 5 or Equation 6.

Encoder 700 and decoder 800 according to the present embodiment have been described above.

As described above, in the present embodiment, encoder 700 performs both the predictive encoding and the mono encoding on the S signal, and selects the encoding mode which achieves a better encoding result. It is thus possible for encoder 700 to efficiently encode the S signal, and decoder 800 can improve the decoding performance for decoding the S signal.

Note that, the present embodiment has been described in which the prediction mode and the normal mode are used as the encoding modes for the S signal. However, the encoding modes for the S signal may be encoding modes other than the prediction mode and the normal mode. Note also that, the present embodiment has been described in which two types of encoding modes are used, but three or more types of encoding modes may be used. For example, when the correlation between the L signal and the R signal is low, MS stereo encoding may not be used, but a mode for LR dual mono encoding may be used.

Further, in the present embodiment, the encoding processing on the S signal may be performed for each subband of a plurality of subbands, or may be performed for the entire plurality of subbands. When the encoding processing on the S signal is performed for each subband of the plurality of subbands, the S-signal encoding information and the mode encoding information are generated for each of the subbands. In addition, in this case, the mode encoding information may be binary encoding information in which a band for which the prediction mode is selected is represented by "1" and a band for which the normal mode is selected is represented by "0," for example.

Embodiment 5

Embodiment 4 has been described in which the encoder encodes each S signal using a plurality of encoding modes, and selects an encoding mode achieving a better encoding result. In contrast, Embodiment 5 will be described in which an encoder selects one encoding mode from a plurality of encoding modes, and encodes an S signal using the selected encoding mode.

Figure 12:
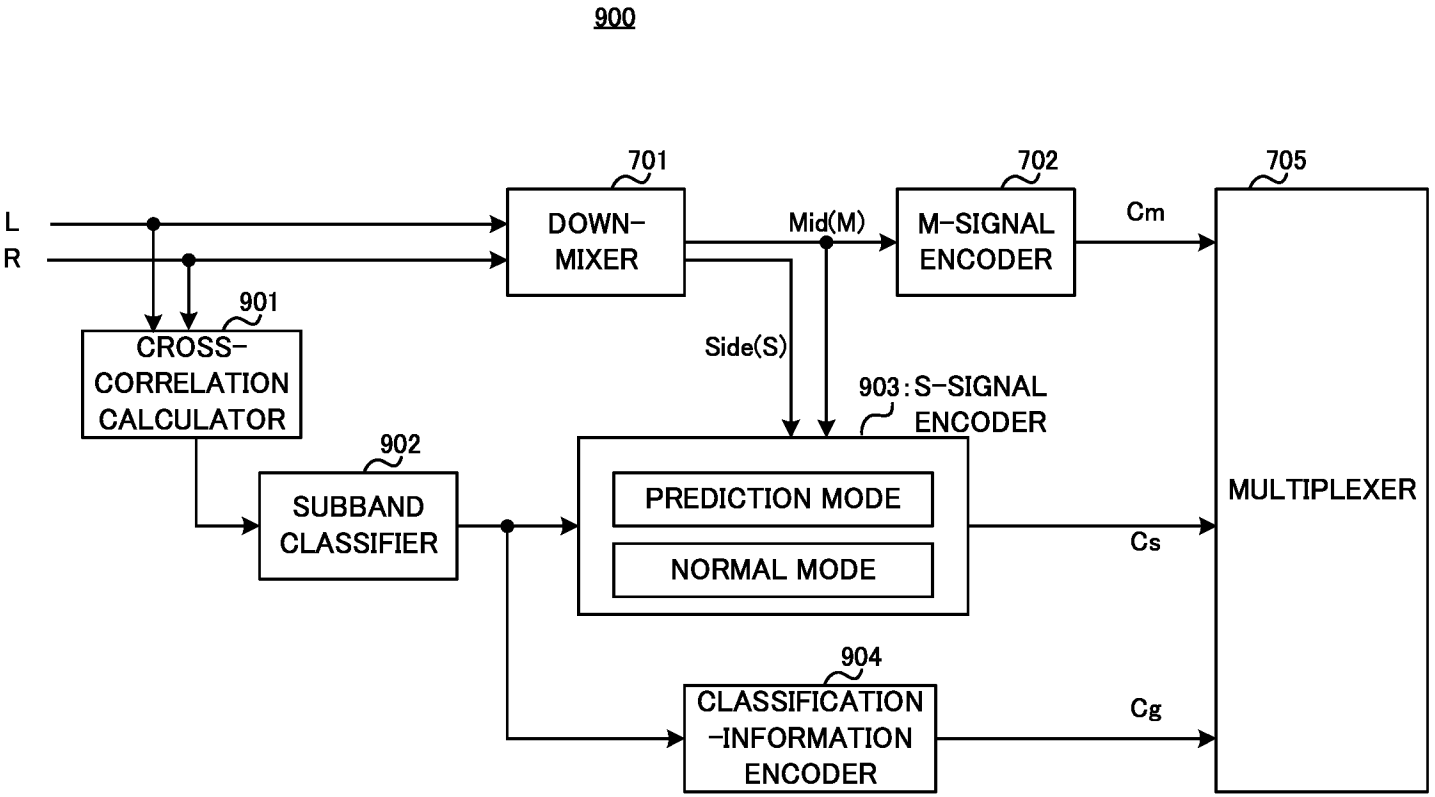
FIG. 12 is a block diagram illustrating a configuration example of an encoder according to Embodiment 5.

FIG. 12 is a block diagram illustrating a configuration example of encoder 900 according to the present embodiment. Note that, the same components between FIG. 12 and Embodiment 4 are provided with the same reference symbols, and descriptions of such components are omitted. Note also that, since a decoder according to the present embodiment has the same basic configuration as decoder 800 according to Embodiment 4, the description will be given with reference to FIG. 11.

In encoder 900 illustrated in FIG. 12, cross-correlation calculator 901 calculates a normalized cross-correlation between inputted L and R signals. For example, cross-correlation calculator 901 calculates the normalized cross-correlation value for each subband. Cross-correlation calculator 901 outputs the calculated normalized cross-correlation value for each subband to subband classifier 902.

For example, cross-correlation calculator 901 calculates normalized cross-correlation value $X_{LR}$ (b) for subband b in accordance with following Equation 17:

[17]

$$X_{LR}(b) = \frac{E(L_b R_b)}{\sqrt{E(L_b^2)E(R_b^2)}} = \frac{\sum_{k=k_{start}(b)}^{k=k_{end}(b)-1} L(k)R^*(k)}{\sqrt{\sum_{k=k_{start}(b)}^{k=k_{end}(b)-1} L(k)L^*(k)}\sqrt{\sum_{k=k_{start}(b)}^{k=k_{end}(b)-1} R(k)R^*(k)}}. \quad \text{(Equation 17)}$$

In Equation 17, "$k_{start}$" denotes the starting number of the spectral coefficient at subband b, "$k_{end}$" denotes the ending number of the spectral coefficient at subband b, wherein "b" is 0, 1, . . . , or $N_{bands}-1$. The character "$N_{bands}$" denotes the number of subbands. Further, "*" denotes a complex conjugate, and function E(x) is a function that returns the expected value of x.

Subband classifier 902 classifies subbands into a plurality of groups based on the normalized cross-correlation value for each subband inputted from cross-correlation calculator 901. The number of groups of subbands may be equal to the number of encoding modes selectable in S-signal encoder 903, for example. For example, subband classifier 902 classifies a subband of a normalized cross-correlation value in a predetermined range as a group corresponding to the prediction mode (e.g., MS predictive encoding), while classifies a subband of a normalized cross-correlation value outside the predetermined range as a group corresponding to the normal mode (e.g., mono encoding). Subband classifier 902 outputs classification information indicating a classification result of classification of subbands to S-signal encoder 903 and classification-information encoder 904.

S-signal encoder 903 selects the encoding mode (for example, either the prediction mode or the normal mode) of the S signal based on the classification information inputted from subband classifier 902. Then, S-signal encoder 903 encodes the S signal inputted from down-mixer 701 based on the selected encoding mode, and outputs encoding result (S-signal encoding information) Cs to multiplexer 705.

Classification-information encoder 904 encodes the classification information inputted from subband classifier 902, and outputs encoding result (mode encoding information) Cg to multiplexer 705. For example, classification-information encoder 904 may generate binary encoding information in which a subband included in the group corresponding to the prediction mode is represented by "1" while a subband included in the group corresponding to the normal mode is represented by "0."

Decoder 800 (for example, see FIG. 11) determines the encoding mode for encoding the S signal for each subband based on the mode encoding information (in other words, classification information), and decodes the S signal according to the determined encoding mode.

Next, a description will be given of an example of a subband classification method for subband classifier 902.

In MS encoding, for example, the more similar the spectral shape of the L signal is to the spectral shape of the R signal (in other words, the greater the normalized cross-correlation value), the more efficiently the S signal indicating the difference between the L signal and the R signal can be encoded using a smaller number of bits. In other words, the greater the normalized cross-correlation value between the L signal and the R signal, the more efficiently the S signal can be encoded by encoding in the normal mode without prediction of the S signal by MS predictive encoding (prediction mode).

On the other hand, when the spectral shapes of the L signal and the R signal are not similar to each other (in other words, when the normalized cross-correlation value is small), the prediction error of the MS predictive encoding (prediction mode) becomes greater, so that the MS predictive encoding may require a greater number of encoding bits than the encoding in the normal mode.

Thus, subband classifier 902 classifies subband b for which normalized cross-correlation value $X_{LR}(b)$ is in the range of from 0.5 to 0.8 as the subband corresponding to the prediction mode, for example. Subband classifier 902 also classifies subband b for which normalized cross-correlation value $X_{LR}(b)$ is outside the range of from 0.5 to 0.8 as the subband corresponding to the normal mode.

Thus, for example, in the case of subband b for which normalized cross-correlation value $X_{LR}(b)$ is greater than 0.8, it is possible for S-signal encoder 903 to encode the S signal highly efficiently using the normal mode because the difference signal (i.e., S signal) between the L signal and the R signal is expected to be small. Further, in the case of subband b for which normalized cross-correlation value $X_{LR}(b)$ is in the range from 0.5 to 0.8, for example, it is possible for S-signal encoder 903 to encode the S signal using the predictive mode to reduce the number of bits of the S-signal encoding information as compared with the case of using the normal mode. In addition, for example, in the case of subband b for which normalized cross-correlation value $X_{LR}(b)$ is less than 0.5, it is possible for S-signal encoder 903 to encode the S signal in the normal mode to avoid an inadvertent increase in the number of bits of the S-signal encoding information.

Note that the range of normalized cross-correlation value $X_{LR}$ (b) for classification as the subband corresponding to the prediction mode is not limited to the range of from 0.5 to 0.8, and may be any other range.

As is understood, encoder 900 can efficiently encode the S signal by selecting an encoding mode in accordance with the correlation between the L signal and the R signal in the present embodiment. Further, since encoder 900 encodes the S signal using one encoding mode selected based on the correlation between the L signal and the R signal, the calculation amount can be reduced as compared with the case where the encoding is performed using each of the plurality of encoding modes.

Note that, the present embodiment has been described in which two types of modes of the prediction mode and the normal mode are used as the encoding modes for the S signal. However, three or more types of the encoding modes for the S signal may be used. In this case, subband classifier 902 may classify a plurality of subbands into the same number of groups as the number of encoding modes for the S signal.

For example, subband classifier 902 may classify subband b for which normalized cross-correlation value $X_{LR}(b)$ is in the range of from 0.5 to 0.8 as a subband corresponding to the prediction mode, subband b for which normalized cross-correlation value $X_{LR}(b)$ is in the range of greater than 0.8 as a subband corresponding to the normal mode (e.g., mono encoding), and subband b for which normalized cross-correlation value $X_{LR}(b)$ is in the range of less than 0.5 as a subband corresponding to the dual mono mode (dual mono encoding). In the dual mono encoding, S-signal encoder 903 performs mono encoding on the L and R signals separately.

Further, the number of types of encoding modes used by encoder 900 is not limited to the aforementioned two or three types, but may also be four or more types.

In addition, although the present embodiment has been described in which the encoding mode is determined for each subband, the present disclosure is not limited to the case where the encoding mode is determined on a subband-by-subband basis. For example, the encoding mode may be determined on a basis of a group of a plurality of subbands, or may be determined for all bands.

Further, although the present embodiment has been described in which encoder 900 selects the encoding mode based on the normalized cross-correlation value between the L signal and the R signal, the parameter serving as the selection criterion for selection of the encoding mode is not limited to the normalized cross-correlation value, and may also be another parameter relating to the correlation between the L signal and the R signal, for example.

Alternatively, the parameter serving as the selection criterion for selection of the encoding mode may also be a prediction gain in M-S prediction. For example, encoder 900 may select the prediction mode when a calculated prediction gain is high (e.g., when the calculated prediction gain is greater than a predetermined threshold or is equal to or greater than a predetermined threshold). The prediction gain may be defined as the S/N ratio between a target signal for prediction (S signal in the present embodiment) and a prediction residual signal (error signal between a prediction S signal and an actual S signal). In this case, the reciprocal of the S/N ratio in the case where the S signal is the target is expressed by following Equation 18:

[18]

$$N/S = \frac{\|S(k) - H_b M(k)\|^2}{\|S(k)\|^2} = \frac{\sum_k \left\| S(k) \frac{X_{SM}(b)}{E(M_{Ene}(b))} M(k) \right\|^2}{\sum_k \|S(k)\|^2} = 1 - \frac{2\frac{E(S_b M_b)}{E(M_{Ene}(b))} \sum_k S(k)M(k) - \left(\frac{E(S_b M_b)}{E(M_{Ene}(b))}\right)^2 \sum_k \|M(k)\|^2}{\sum_k \|S(k)\|^2} \quad \text{(Equation 18)}$$

-continued $$= 1 - \frac{(E(S_b M_b))^2}{E(M_{Ene}(b))} \Big/ E(S_{Ene}(b))$$

$$= 1 - \frac{(E(S_b M_b))^2}{E(S_{Ene}(b))E(M_{Ene}(b))}$$

$$= 1 - \frac{(x_{SM}(b))^2}{E(S_{Ene}(b))E(M_{Ene}(b))}.$$

In Equation 18, "$M_{Ene}(b)$" denotes the energy of the M signal at subband b, "$S_{Ene}(b)$" denotes the energy of the S signal at subband b, "$X_{SM}(b)$" denotes the cross-correlation value between the S signal and the M signal at subband b, "$S_b$" denotes the S signal at subband b, "$M_b$" denotes the M signal at subband b, "$S_bM_b$" denotes the cross-spectrum between the S signal and the M signal at subband b, "S(k)" denotes the S signal at each frequency bin k within subband b, "M(k)" denotes the M signal at each frequency bin k within subband b, and "$H_b$" denotes the M-S prediction coefficient at subband b (see, e.g., Equation 7). Function E(x) represents a function that returns the expected value of x.

Figure 13:
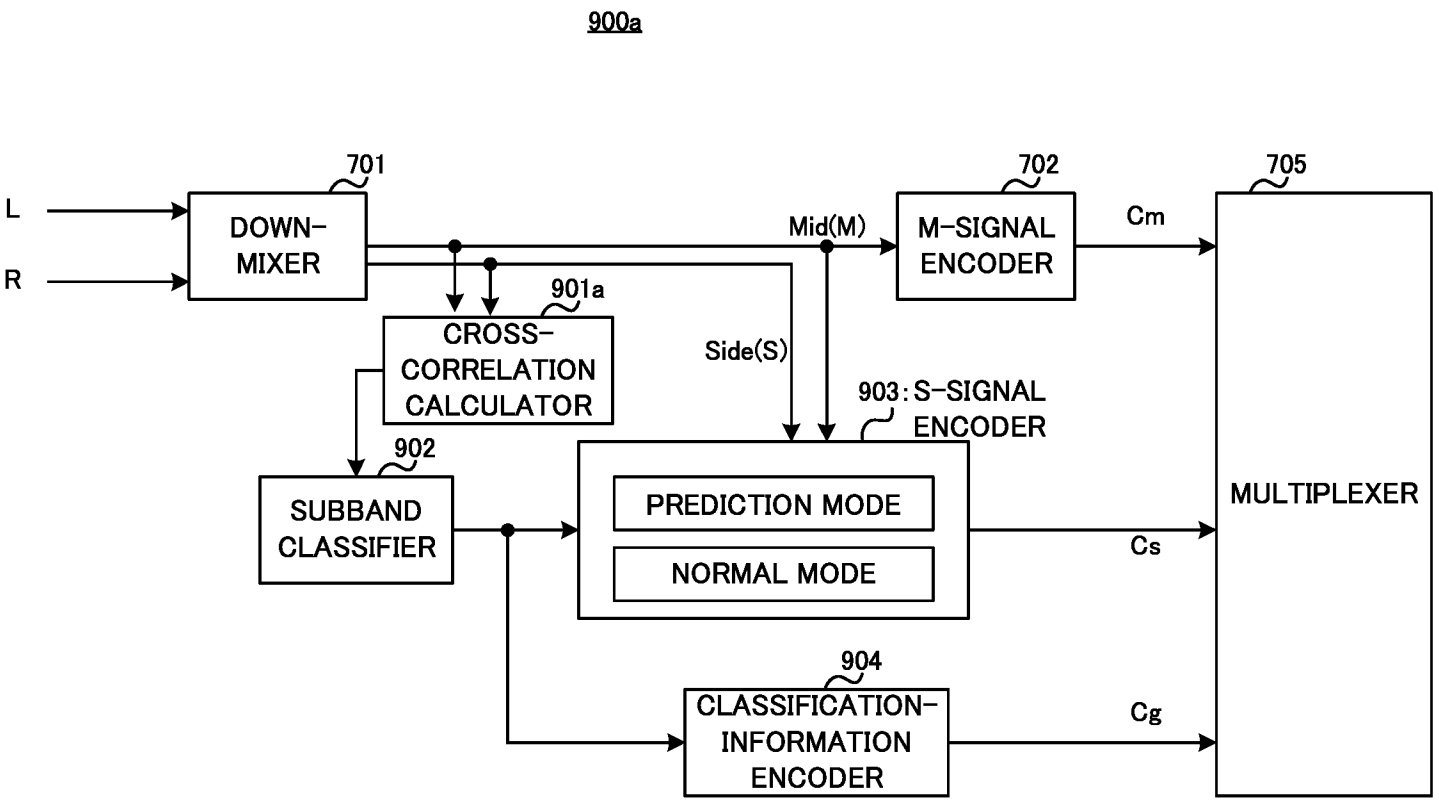
FIG. 13 is a block diagram illustrating another configuration example of the encoder according to Embodiment 5.

According to Equation 18, the greater the $(X_{SM}(b))^2/E(S_{Ene}(b))E(M_{Ene}(b))$ is, the higher the prediction gain is. In other words, encoder 900 calculates the "normalized cross-correlation between the M signal and the S signal," which is obtained by normalizing the square of the cross-correlation between the M signal and the S signal by a value resulting from multiplication of the energy of the M signal by the energy of the S signal. Then, when the "normalized cross-correlation between the M signal and the S signal" is equal to or greater than a predetermined threshold (or is greater than a threshold), encoder 900 may determine that the prediction gain is high, and may use the prediction mode. Further, when encoder 900 is configured to use the dual mono encoding mode when the prediction gain is low, for example, the encoder does not need to calculate the cross-correlation (for example, Equation 17 or an equivalent equation) between the L signal and the R signal for determining the mode. FIG. 13 illustrates a configuration of encoder 900*a* for this case. Comparison between encoder 900*a* illustrated in FIG. 13 and encoder 900 (FIG. 12) reveals that the former differs from the latter in that input signals to cross-correlation calculator 901*a* are the M signal and the S signal, which are output signals from down-mixer 701. Further, FIG. 13 illustrates that cross-correlation calculator 901*a* calculates the "normalized cross-correlation between the M signal and the S signal" described above.

The embodiments of the present disclosure have been described above.

Note that, the present disclosure can be realized by software, hardware, or software in cooperation with hardware. Each functional block used in the description of each embodiment described above can be partly or entirely realized by an LSI such as an integrated circuit, and each process described in the each embodiment may be controlled partly or entirely by the same LSI or a combination of LSIs. The LSI may be individually formed as chips, or one chip may be formed so as to include a part or all of the functional blocks. The LSI may include a data input and output coupled thereto. The LSI here may be referred to as an IC, a system LSI, a super LSI, or an ultra LSI depending on a difference in the degree of integration. However, the technique of implementing an integrated circuit is not limited to the LSI and may be realized by using a dedicated circuit, a general-purpose processor, or a special-purpose processor. In addition, a FPGA (Field Programmable Gate Array) that can be programmed after the manufacture of the LSI or a reconfigurable processor in which the connections and the settings of circuit cells disposed inside the LSI can be reconfigured may be used. The present disclosure can be realized as digital processing or analogue processing. If future integrated circuit technology replaces LSIs as a result of the advancement of semiconductor technology or other derivative technology, the functional blocks could be integrated using the future integrated circuit technology.

Biotechnology can Also be Applied.

The present disclosure can be realized by any kind of apparatus, device or system having a function of communication, which is referred to as a communication apparatus. Some non-limiting examples of such a communication apparatus include a phone (e.g., cellular (cell) phone, smart phone), a tablet, a personal computer (PC) (e.g., laptop, desktop, netbook), a camera (e.g., digital still/video camera), a digital player (digital audio/video player), a wearable device (e.g., wearable camera, smart watch, tracking device), a game console, a digital book reader, a telehealth/telemedicine (remote health and medicine) device, and a vehicle providing communication functionality (e.g., automotive, airplane, ship), and various combinations thereof.

The communication apparatus is not limited to be portable or movable, and may also include any kind of apparatus, device or system being non-portable or stationary, such as a smart home device (e.g., an appliance, lighting, smart meter, control panel), a vending machine, and any other "things" in a network of an "Internet of Things (IoT)."

The communication may include exchanging data through, for example, a cellular system, a radio LAN system, a satellite system, etc., and various combinations thereof.

The communication apparatus may comprise a device such as a controller or a sensor which is coupled to a communication device performing a function of communication described in the present disclosure. For example, the communication apparatus may comprise a controller or a sensor that generates control signals or data signals which are used by a communication device performing a communication function of the communication apparatus.

The communication apparatus also may include an infrastructure facility, such as a base station, an access point, and any other apparatus, device or system that communicates with or controls apparatuses such as those in the above non-limiting examples.

An encoder in an exemplary embodiment of the present disclosure includes: first encoding circuitry, which, in operation, encodes a sum signal to generate first encoding information, the sum signal indicating a sum of a left channel signal and a right channel signal constituting a stereo signal; calculation circuitry, which, in operation, calculates a prediction parameter using a parameter relating to an energy difference between the left channel signal and the right channel signal, the prediction parameter being a parameter for predicting a difference signal indicating a difference between the left channel signal and the right channel signal; and second encoding circuitry, which, in operation, encodes the prediction parameter to generate second encoding information.

The encoder in an exemplary embodiment of the present disclosure further includes: prediction circuitry, which, in operation, predicts the difference signal using the prediction parameter and the sum signal to generate a prediction difference signal; and third encoding circuitry, which, in operation, encodes a residual signal between the difference signal and the prediction difference signal to generate third encoding information.

In the encoder in an exemplary embodiment of the present disclosure, the third encoding information includes an encoding result of encoding of a residual signal between the sum signal and a decoded sum signal obtained by decoding the first encoding information.

In the encoder in an exemplary embodiment of the present disclosure, the parameter relating to the energy difference is a coefficient obtained by normalizing, by energy of a decoded sum signal obtained by decoding the first encoding information, a correlation value between the decoded sum signal and the difference signal.

In the encoder in an exemplary embodiment of the present disclosure, the second encoding circuitry performs entropy encoding on the prediction parameter.

An encoding method in an exemplary embodiment of the present disclosure includes: encoding a sum signal to generate first encoding information, the sum signal indicating a sum of a left channel signal and a right channel signal constituting a stereo signal; calculating a prediction parameter using a parameter relating to an energy difference between the left channel signal and the right channel signal, the prediction parameter being a parameter for predicting a difference signal indicating a difference between the left channel signal and the right channel signal; and encoding the prediction parameter to generate second encoding information.

The disclosures of Japanese Patent Application No. 2018-126842 filed on Jul. 3, 2018 and Japanese Patent Application No. 2018-209940 filed on Nov. 7, 2018 including the specifications, drawings and abstracts are incorporated herein by reference in their entirety.

INDUSTRIAL APPLICABILITY

An exemplary embodiment of the present disclosure is useful for speech communication systems using MS predictive encoding techniques.

REFERENCE SIGNS LIST

100, 300, 500, 700, 900, 900*a* Encoder
101 Energy-difference calculator
102, 302 Quantizer
103, 303 Entropy encoder
104, 304, 505 Inverse quantizer
105, 501, 701 Down-mixer
106, 502, 702 M-signal encoder
107, 110, 206, 209 Adder
108, 207 M-signal energy calculator
109, 208, 305, 404 M-S predictor
111, 306, 508 Residual encoder
112, 509, 705 Multiplexer
200, 400, 600, 800 Decoder
201, 601, 801 Separator
202, 401 Entropy decoder
203 Energy-difference decoder
204, 403, 604 Residual decoder
205, 602, 802 M-signal decoder
210, 805 Up-mixer
301, 503 Prediction-coefficient calculator
402 Prediction-coefficient decoder
504 Quantization encoder
506, 605 Channel predictor
507 Residual calculator
603 Prediction-coefficient decoding inverse quantizer
606 Adder
703, 903 S-signal encoder
704 Encoding-mode encoder
803 Encoding-mode decoder
804 S-signal decoder
901, 901*a* Cross-correlation calculator
902 Subband classifier
904 Classification-information encoder

The invention claimed is:

1. An encoder, comprising:

first encoding circuitry, which, in operation, encodes a sum signal to generate first encoding information, the sum signal indicating a sum of a left channel signal and a right channel signal constituting a stereo signal;

calculation circuitry, which, in operation, calculates a prediction parameter using a parameter relating to an energy difference between the left channel signal and the right channel signal, the prediction parameter being a parameter for predicting a difference signal indicating a difference between the left channel signal and the right channel signal; and second encoding circuitry, which, in operation, encodes the prediction parameter to generate second encoding information, wherein the parameter relating to the energy difference is a coefficient obtained by normalizing, by energy of a decoded sum signal obtained by decoding the first encoding information, a correlation value between the decoded sum signal and the difference signal.

2. The encoder according to claim 1, further comprising:

prediction circuitry, which, in operation, predicts the difference signal using the prediction parameter and the decoded sum signal to generate a prediction difference signal; and third encoding circuitry, which, in operation, encodes a residual signal between the difference signal and the prediction difference signal to generate third encoding information.

3. The encoder according to claim 2, wherein the third encoding information includes an encoding result of encoding of a residual signal between the sum signal and a decoded sum signal obtained by decoding the first encoding information.

4. The encoder according to claim 1, wherein the second encoding circuitry performs entropy encoding on the prediction parameter.

5. The encoder according to claim 1, wherein the calculation circuitry calculates the prediction parameter using the decoded sum signal regardless of whether the coefficient is obtained by using the sum signal or the decoded sum signal.

6. The encoder according to claim 1, wherein the encoder switches between a first mode and a second mode, the first mode being a mode in which the second encoding information is outputted, and the second mode being a mode in which fourth encoding information is outputted, the fourth encoding information is generated by a mono encoding on the difference signal.

7. An encoding method, comprising:

encoding a sum signal to generate first encoding information, the sum signal indicating a sum of a left channel signal and a right channel signal constituting a stereo signal;

calculating a prediction parameter using a parameter relating to an energy difference between the left channel signal and the right channel signal, the prediction parameter being a parameter for predicting a difference signal indicating a difference between the left channel signal and the right channel signal; and encoding the prediction parameter to generate second encoding information, wherein the parameter relating to the energy difference is a coefficient obtained by normalizing, by energy of a decoded sum signal obtained by decoding the first encoding information, a correlation value between the decoded sum signal and the difference signal.

* * * * *